US007848925B2

(12) United States Patent
Ehara

(10) Patent No.: US 7,848,925 B2
(45) Date of Patent: Dec. 7, 2010

(54) SCALABLE ENCODING APPARATUS, SCALABLE DECODING APPARATUS, SCALABLE ENCODING METHOD, SCALABLE DECODING METHOD, COMMUNICATION TERMINAL APPARATUS, AND BASE STATION APPARATUS

(75) Inventor: Hiroyuki Ehara, Kanagawa (JP)

(73) Assignee: Panasonic Corporation, Osaka (JP)

( * ) Notice: Subject to any disclaimer, the term of this patent is extended or adjusted under 35 U.S.C. 154(b) by 937 days.

(21) Appl. No.: 11/575,257

(22) PCT Filed: Sep. 15, 2005

(86) PCT No.: PCT/JP2005/017054

§ 371 (c)(1),
(2), (4) Date: Mar. 14, 2007

(87) PCT Pub. No.: WO2006/030865

PCT Pub. Date: Mar. 23, 2006

(65) Prior Publication Data

US 2008/0059166 A1 Mar. 6, 2008

(30) Foreign Application Priority Data

Sep. 17, 2004 (JP) ..... 2004-272481
Nov. 12, 2004 (JP) ..... 2004-329094
Sep. 2, 2005 (JP) ..... 2005-255242

(51) Int. Cl.
*G10L 19/00* (2006.01)
*G10L 11/00* (2006.01)

(52) U.S. Cl. ..... 704/230; 704/206; 704/219; 704/500

(58) Field of Classification Search ..... None
See application file for complete search history.

(56) References Cited

U.S. PATENT DOCUMENTS 4,890,327 A 12/1989 Bertrand et al.

(Continued)

FOREIGN PATENT DOCUMENTS

EP 0607989 7/1994

(Continued)

OTHER PUBLICATIONS

Ehara, H. et al. Predictive VQ for bandwidth scalable LSP quantization, Acoustics, Speech, and Signal Processing, 2005. Proceedings. (ICASSP '05). IEEE International Conference on Date:Mar. 23-23, 2005.*

(Continued)

*Primary Examiner*—Matthew J Sked
(74) *Attorney, Agent, or Firm*—Greenblum & Bernstein P.L.C.

(57) ABSTRACT

A scalable encoding apparatus, a scalable decoding apparatus and the like are disclosed which can achieve a band scalable LSP encoding that exhibits both a high quantization efficiency and a high performance. In these apparatuses, a narrow band-to-wide band converter receives and converts a quantized narrow band LSP to a wide band, and then outputs the quantized narrow band LSP as converted (i.e., a converted wide band LSP parameter) to an LSP-to-LPC converter. The LSP-to-LPC converter converts the quantized narrow band LSP as converted to a linear prediction coefficient and then outputs it to a pre-emphasizer. The pre-emphasizer calculates and outputs the pre-emphasized linear prediction coefficient to an LPC-to-LSP converter. The LPC-to-LSP converter converts the pre-emphasized linear prediction coefficient to a pre-emphasized quantized narrow band LSP as wide band converted, and then outputs it to a prediction quantizer.

22 Claims, 12 Drawing Sheets

U.S. PATENT DOCUMENTS

| | | | | |
|---|---|---|---|---|
| 5,648,989 | A | 7/1997 | Ko | |
| 5,966,688 | A * | 10/1999 | Nandkumar et al. | 704/222 |
| 6,208,957 | B1 | 3/2001 | Nomura | |
| 6,246,979 | B1 | 6/2001 | Carl | |
| 6,539,355 | B1 | 3/2003 | Omori et al. | |
| 2002/0052739 | A1 | 5/2002 | Oishi | |
| 2003/0028386 | A1 | 2/2003 | Zinser, Jr. et al. | |
| 2003/0050775 | A1 | 3/2003 | Zinser, Jr. et al. | |
| 2003/0093268 | A1 | 5/2003 | Zinser, Jr. et al. | |
| 2003/0105628 | A1 | 6/2003 | Zinser, Jr. et al. | |
| 2003/0115046 | A1 | 6/2003 | Zinser, Jr. et al. | |
| 2003/0125935 | A1 | 7/2003 | Zinser, Jr. et al. | |
| 2003/0125939 | A1 | 7/2003 | Zinser, Jr. et al. | |
| 2003/0135366 | A1 | 7/2003 | Zinser, Jr. et al. | |
| 2003/0135368 | A1 | 7/2003 | Zinser, Jr. et al. | |
| 2003/0135370 | A1 | 7/2003 | Zinser, Jr. et al. | |
| 2003/0135372 | A1 | 7/2003 | Zinser, Jr. et al. | |
| 2003/0144835 | A1 | 7/2003 | Zinser, Jr. et al. | |
| 2003/0195745 | A1 | 10/2003 | Zinser, Jr. et al. | |
| 2005/0004803 | A1 * | 1/2005 | Smeets et al. | 704/500 |
| 2005/0159943 | A1 | 7/2005 | Zinser, Jr. et al. | |
| 2005/0163323 | A1 | 7/2005 | Oshikiri | |

FOREIGN PATENT DOCUMENTS

| | | |
|---|---|---|
| EP | 0732687 | 9/1996 |
| EP | 1158495 | 11/2001 |
| EP | 1431962 | 6/2004 |
| EP | 1533789 | 5/2005 |
| JP | 8-123495 | 5/1996 |
| JP | 8-263096 | 10/1996 |
| JP | 8-293932 | 11/1996 |
| JP | 9-127985 | 5/1997 |
| JP | 11-030997 | 2/1999 |
| JP | 2000-122679 | 4/2000 |
| JP | 2001-509616 | 7/2001 |
| JP | 201-337700 | 12/2001 |
| JP | 2002-140098 | 5/2002 |
| JP | 2003-241799 | 8/2003 |
| JP | 2003-323199 | 11/2003 |
| JP | 2004-101720 | 4/2004 |
| WO | 02/080147 | 10/2002 |

OTHER PUBLICATIONS

Chennoukh, S. et al. "Speech enhancement via frequency bandwidth extension using line spectral frequencies," ICASSP IEEE Int Conf Acoust Speech Signal Process Proc. vol. 1, pp. 665-668. 2001.*

Guibé, G., How, H. T. and Hanzo, L., "Speech Spectral Quantizers for Wideband Speech Coding," (2001) Speech Spectral Quantizers for Wideband Speech Coding. European Transactions on Telecommunications, 12 (6). pp. 535-545.*

English Language Abstract of JP 2003-241799.

English Language Abstract of JP 11-030997.

U.S. Appl. No. 11/573,761 to Ehara et al., which was filed Feb. 15, 2007.

U.S. Appl. No. 11/573,765 to Ehara, which was filed Feb. 15, 2007.

U.S. Appl. No. 11/576,264 to Goto et al., which was filed Mar. 29, 2007.

Koishita et al., "A 16-KBit/s bandwidth scalable audio coder based on the G.729 standard," Acoustics, Speech, and Signal Processing, 2000, ICAASP'00, Proceedings, 2000 IEEE International Conference on Jun. 5-9, 2000, Piscataway, NJ, USA, IEEE, vol. 2, Jun. 5, 2000, pp. 1149-1152, XP010504931.

Nomura et al., "A bitrate and bandwidth scalable CELP coder," Acoustics, Speech, and Signal Processing, 1998, Proceedings of the 1998 IEEE International Conference on Seattle, WA, USA, May 12-15, 1998, New York, NY, USA, IEEE, US, vol. 1, May 12, 1998, pp. 341-344, XP010279059.

Zinser et al., "2.4 KB/Sec compressed domain teleconference bridge with universal transcoder," 2001 IEEE International Conference on Acoustics, Speech, and Signal Processing, Proceedings (ICASSP), Salt Lake City, UT, May 7-11, 2001, IEEE International Conference on Acoustics, Speech, and Signal Processing, Proceedings (ICAASP), New York, NY, IEEE, US, vol. vol. 1 of 6, May 7, 2001, pp. 957-960, XP01083714.

Varho et al., "Separated linear prediction—A new all-pole modeling technique for speech analysis," Speech Communication, Elsevier Science Publishers, Amsterdam, NL, vol. 24, No. 2, May, 1998, pp. 111-121, XP004127158.

* cited by examiner

SCALABLE ENCODING APPARATUS, SCALABLE DECODING APPARATUS, SCALABLE ENCODING METHOD, SCALABLE DECODING METHOD, COMMUNICATION TERMINAL APPARATUS, AND BASE STATION APPARATUS

TECHNICAL FIELD

The present invention relates to a communication terminal apparatus and base station apparatus, to a scalable encoding apparatus and a scalable decoding apparatus that are mounted in the communication terminal apparatus and base station apparatus, and to a scalable encoding method and a scalable decoding method that are used during voice communication in a mobile communication system or a packet communication system that uses Internet Protocol.

BACKGROUND ART

There is a need for an encoding system that is robust against frame loss in the encoding of voice data in voice communication that uses packets, such as VoIP (Voice over IP) or the like. This is because packets on a transmission path are sometimes lost in packet communication, of which Internet communication is a typical example.

One method for increasing robustness against frame loss is an approach to minimize the effects of frame loss by decoding one portion of transmission information when another portion of the transmission information is lost (see, for example, Patent Document 1). Patent Document 1 discloses a method whereby encoding information of a core layer and encoding information of an enhancement layer are packed into separate packets using scalable encoding for transmission. Applications of packet communication include multicast communication (one-to-many communication) using a network that includes a mixture of thick lines (broadband lines) and thin lines (lines having a low transmission rate). Scalable encoding is also effective when communication between multiple points is performed on the type of heterogeneous network described above, because it is not necessary to transmit different encoding information for each network when the encoding information is stratified according to each network.

The technique disclosed in Patent Document 2 is an example of a bandwidth-scalable encoding technique that has scalability (in the frequency axis direction) in the signal bandwidth and is based on a CELP (Code Excited Linear Prediction) system that is capable of high-efficiency encoding of voice signals. Patent Document 2 discloses an example of a CELP system for representing spectral envelope information of a voice signal using LSP (Line Spectrum Pair) parameters. A quantized LSP parameter (narrowband-encoded LSP) obtained by an encoding unit (core layer) used for narrowband voice is converted to an LSP parameter for wideband voice encoding using the equation (1) below, $$fw(i) = 0.5 \times fn(i) \quad [\text{wherein } i = 0, \ldots, P_n - 1] \qquad (1)$$
$$= 0.0 \quad [\text{wherein } i = P_n, \ldots, P_w - 1]$$

and the converted LSP parameter is used by an encoding unit (enhancement layer) for wideband voice, whereby a bandwidth-scalable LSP encoding method is created. In the equation, fw(i) is the i-th element of the LSP parameter in the wideband signal, fn(i) is the i-th element of the LSP parameter in the narrowband signal, $P_n$ is the LSP analysis order of the narrowband signal, and $P_w$ is the LSP analysis order of the wideband signal. LSP is also referred to as LSF (Line Spectral Frequency).

Patent Document 1: Japanese Patent Application Laid-Open No. 2003-241799

Patent Document 2: Japanese Patent Application Laid-Open No. 11-30997

DISCLOSURE OF INVENTION

Problems to Be Solved by the Invention

However, in Patent Document 2, since the quantized LSP parameter (narrowband LSP) obtained by narrowband voice encoding is simply multiplied by a constant and used to predict the LSP parameter (wideband LSP) with respect to the wideband signal, this method cannot be described as making maximal use of the narrowband LSP information, and a wideband LSP encoding apparatus whose design is based on Equation (1) has inadequate quantization efficiency and other inadequate aspects of encoding performance.

An object of the present invention is to provide a scalable encoding apparatus and a scalable decoding apparatus or other apparatus capable of high-performance scalable LSP encoding that has high quantization efficiency.

Means for Solving the Problem

The scalable encoding apparatus according to the present invention for solving the above problems performs predictive quantization of a wideband LSP parameter by using a narrowband quantized LSP parameter, the scalable encoding apparatus comprising a pre-emphasizing section that pre-emphasizes a quantized narrowband LSP parameter, wherein the pre-emphasized quantized narrowband LSP parameter is used in the predictive quantization.

The scalable decoding apparatus according to the present invention decodes a wideband LSP parameter by using a narrowband quantized LSP parameter, the scalable decoding apparatus comprising a pre-emphasizing section that pre-emphasizes a quantized narrowband LSP parameter decoded, wherein the pre-emphasized quantized narrowband LSP parameter is used to decode the wideband LSP parameter.

The scalable encoding method according to the present invention performs predictive quantization of a wideband LSP parameter by using a narrowband quantized LSP parameter, the scalable encoding method comprising a pre-emphasizing step that pre-emphasizes a quantized narrowband LSP parameter, and a quantization step that performs the predictive quantization by using the pre-emphasized quantized narrowband LSP parameter.

The scalable decoding method according to the present invention decodes a wideband LSP parameter by using a narrowband quantized LSP parameter, the scalable decoding method comprising a pre-emphasizing step that pre-emphasizes a quantized narrowband LSP parameter decoded, and an LSP parameter decoding step that decodes the wideband LSP parameter by using the pre-emphasized quantized narrowband LSP parameter.

ADVANTAGEOUS EFFECT OF THE INVENTION

Performing pre-emphasis processing of the narrowband LSP according to the present invention makes it possible to perform high-performance predictive quantization of a wideband LSP using the narrowband LSP in a scalable encoding apparatus structured so that pre-emphasis is not used during analysis of a narrowband signal and that pre-emphasis is used during analysis of a wideband signal.

According to the present invention, high-performance, bandwidth-scalable LSP encoding that has high efficiency of quantization can be performed by adaptively encoding a wideband LSP parameter by using narrowband LSP information.

Furthermore, in encoding of a wideband LSP parameter according to the present invention, the wideband LSP parameter is first classified as a class, a sub-codebook that is correlated with the classified class is then selected, and the selected sub-codebook is then used to perform multistage vector quantization. Therefore, the characteristics of the source signal can be accurately reflected in the encoded data, and the amount of memory can be reduced in the multistage vector quantization codebook that has the sub-codebooks.

BEST MODE FOR CARRYING OUT THE INVENTION

Figure 1:
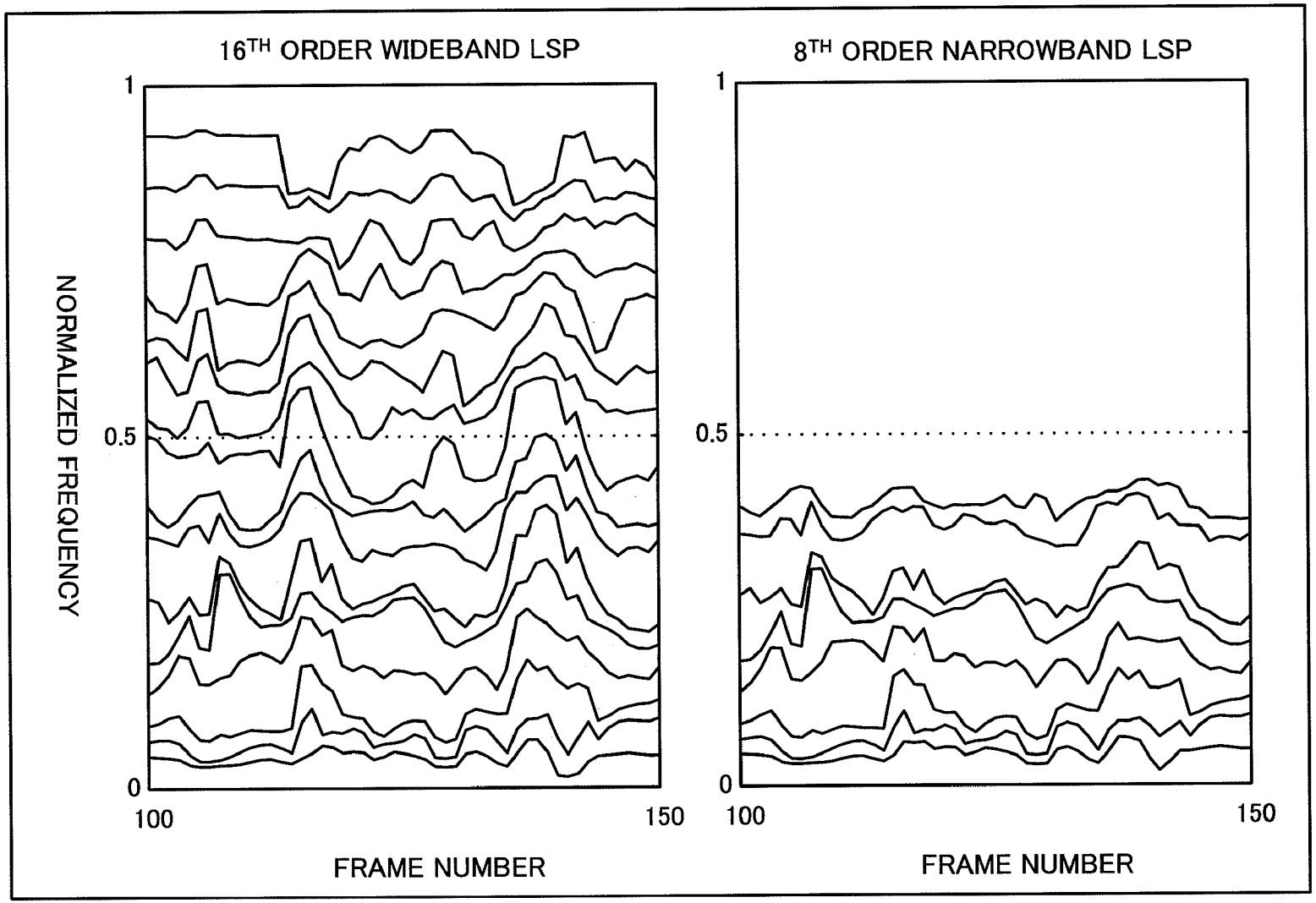
FIG. 1 is a graph in which examples of wideband LSP parameters and narrowband LSP parameters are plotted for each frame number.

FIG. 1 is a graph in which a 16th-order wideband LSP (in which the 16th-order LSP is calculated from a wideband signal: left graph of FIG. 1) and an 8th-order narrowband LSP (in which the 8th-order LSP is calculated from a narrowband signal and converted by Equation (1) right graph of FIG. 1) are plotted with the frame number on the horizontal axis. In these graphs, the horizontal axis indicates time (analysis frame number), and the vertical axis indicates the normalized frequency (1.0=Nyquist frequency (8 kHz in this example)).

The following are made from these graphs. First, the LSP obtained from Equation (1) is valid as an approximation of the lower-side 8th order of the wideband LSP, although it is not always approximated with high precision. Second, since the signal component of a narrowband signal disappears (decays) in the vicinity of 3.4 kHz, when the wideband LSP exists in a neighbor of a normalized frequency of 0.5, the corresponding narrowband LSP becomes clipped in the vicinity of 3.4 kHz, and the error in the approximated value obtained from Equation (1) increases. Conversely, when the 8th element of the narrowband LSP is in the vicinity of 3.4 kHz, there is a higher probability that the 8th element of the wideband LSP is in a frequency of 3.4 kHz or higher, and the characteristics of the wideband LSP can thus be predicted to a certain degree from the narrowband LSP.

In other words, we can say the followings; (1) the narrowband LSP substantially exhibits the characteristics of the lower-order half of the wideband LSP, (2) since there is a certain degree of correlation between the wideband LSP and the narrowband LSP, it may be possible to somewhat narrow down the possible candidates for the wideband LSP if the narrowband LSP is known. Particularly for a signal such as a voice signal, when the narrowband LSP is determined, the types of wideband LSP that would include such characteristics are narrowed down somewhat, although not uniquely determined (e.g., when the narrowband LSP has the characteristics of the voice signal "A," it is highly probable that the wideband LSP also has the characteristics of the voice signal "A," and the vector space that includes the pattern of an LSP parameter that has such characteristics is somewhat limited).

By actively utilizing this type of relationship between the LSP obtained from the narrowband signal and the LSP obtained from the wideband signal, it is possible to increase the quantization efficiency of the LSP obtained from the wideband signal.

Embodiments of the present invention will be described in detail hereinafter with reference to the accompanying drawings.

Embodiment 1

Figure 2:
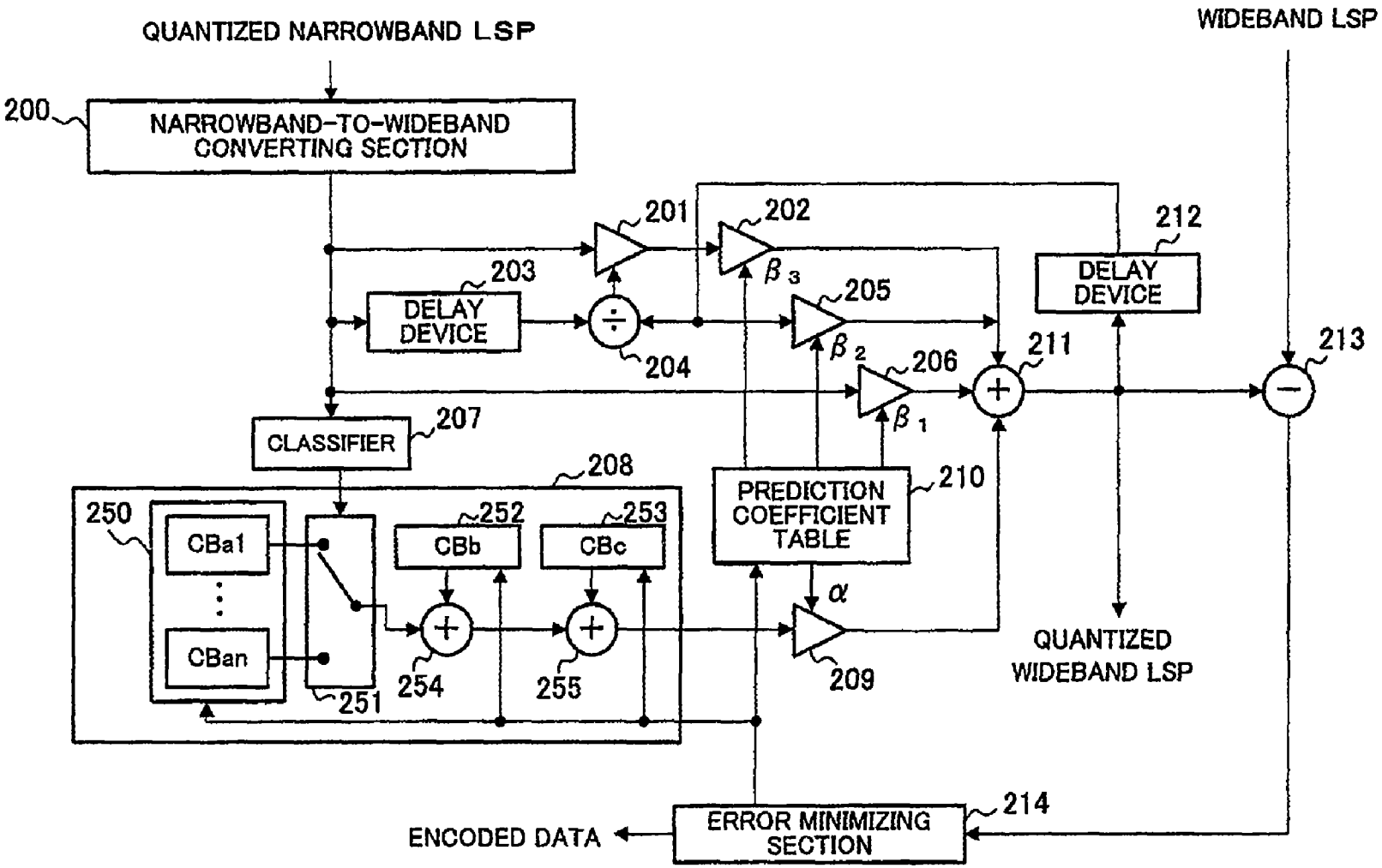
FIG. 2 is a block diagram showing the overall structure of the scalable encoding apparatus according to Embodiment 1.

FIG. 2 is a block diagram showing the overall structure of the scalable encoding apparatus according to Embodiment 1.

The scalable encoding apparatus according to the present embodiment is provided with narrowband-to-wideband converting section 200, amplifier 201, amplifier 202, delay device 203, divider 204, amplifier 205, amplifier 206, classifier 207, multistage vector quantization codebook 208, amplifier 209, prediction coefficient table 210, adder 211, delay device 212, subtracter 213, and error minimizing section 214.

Multistage vector quantization codebook 208 is provided with initial-stage codebook 250, selecting switch 251, second-stage codebook (CBb) 252, third-stage codebook (CBc) 253, and adders 254, 255.

The components of the scalable encoding apparatus of the present embodiment perform the operations described below.

Narrowband-to-wideband converting section 200 converts an inputted quantized narrowband LSP (LSP parameter of a narrowband signal that is quantized in advance by a narrowband LSP quantizer (not shown)) to a wideband LSP parameter by using Equation (1) or the like and outputs the wideband LSP parameter to amplifier 201, delay device 203, amplifier 206, and classifier 207. When Equation (1) is used in the method for converting the narrowband LSP parameter to the wideband LSP parameter, it is difficult to obtain a correspondence between the obtained wideband LSP parameter and the actual input wideband LSP unless the LSP orders and sampling frequencies of the wideband and narrowband signals have a double relationship (the sampling frequency of the wideband signal is twice the sampling frequency of the narrowband signal, and the analysis order of the wideband LSP is twice the analysis order of the narrowband LSP). In the case where this double relationship does not exist, the following procedure may be taken. The wideband LSP parameter is once converted to auto-correlation coefficients, and the auto-correlation coefficients are up-sampled, and then the up-sampled auto-correlation coefficients are reconverted to a wideband LSP parameter.

The quantized narrowband LSP parameter that is converted to wideband form by narrowband-to-wideband converting section 200 is sometimes referred to in the following description as the converted wideband LSP parameter.

Amplifier 201 multiplies the converted wideband LSP parameter inputted from narrowband-to-wideband converting section 200 by an amplification coefficient inputted from divider 204, and outputs the result to amplifier 202.

Amplifier 202 multiplies a prediction coefficient $\beta_3$ (that has a value for each vector element) inputted from prediction coefficient table 210 by the converted wideband LSP parameter that is inputted from amplifier 201, and outputs the result to adder 211.

Delay device 203 imparts a time delay of one frame to the converted wideband LSP parameter inputted from narrowband-to-wideband converting section 200, and outputs the result to divider 204.

Divider 204 divides the quantized wideband LSP parameter of one frame prior inputted from delay device 212 by the quantized converted wideband LSP parameter of one frame prior inputted from delay device 203, and outputs the result to amplifier 201.

Amplifier 205 multiplies the quantized wideband LSP parameter of one frame prior inputted from delay device 212 by a prediction coefficient $\beta_2$ (that has a value for each vector element) that is inputted from prediction coefficient table 210, and outputs the result to adder 211.

Amplifier 206 multiplies the converted wideband LSP parameter inputted from narrowband-to-wideband converting section 200 by a prediction coefficient $\beta_1$ (that has a value for each vector element) that is inputted from prediction coefficient table 210, and outputs the result to adder 211.

Classifier 207 uses the converted wideband LSP parameter inputted from narrowband-to-wideband converting section 200 to perform classification, and class information that indicates the selected class is outputted to selecting switch 251 in multistage vector quantization codebook 208. Any type of method may be used in classification herein, and a configuration may be adopted in which classifier 207 is equipped with a codebook that stores the same number of code vectors as the number of types of possible classes, and class information is outputted that corresponds to the code vector for which the square error between the converted wideband LSP parameter inputted and the stored code vector aforementioned is minimized, for example. The square error may also be weighted with consideration for auditory characteristics. A specific example of the structure of classifier 207 is described hereinafter.

Selecting switch 251 selects a single sub-codebook (CBa1 to CBan) that is correlated with class information inputted from classifier 207 from among first-stage codebooks 250 and connects an output terminal of the selected sub-codebook to adder 254. In the present embodiment, the number of possible classes selected by classifier 207 is n, there are n types of sub-codebooks, and selecting switch 251 is connected to the output terminal of the sub-codebook of the class that is specified from among n types.

First-stage codebook 250 outputs the indicated code vector to adder 254 via selecting switch 251 according to an instruction from error minimizing section 214.

Second-stage codebook 252 outputs the indicated code vector to adder 254 according to an instruction from error minimizing section 214.

Adder 254 adds the code vector of first-stage codebook 250 that was inputted from selecting switch 251 to the code vector that was inputted from second-stage codebook 252, and outputs the result to adder 255.

Third-stage codebook 253 outputs the indicated code vector to adder 255 according to an instruction from error minimizing section 214.

Adder 255 adds the vector inputted from adder 254 to the code vector inputted from third-stage codebook 253, and outputs the result to amplifier 209.

Amplifier 209 multiplies the vector inputted from adder 255 by a prediction coefficient $\alpha$ (that has a value for each vector element) inputted from prediction coefficient table 210, and outputs the result to adder 211.

Prediction coefficient table 210 selects a single set indicated from among the stored prediction coefficient sets according to an instruction from error minimizing section 214, and outputs a coefficient for amplifiers 202, 205, 206, and 209 from the selected set of prediction coefficients to each amplifier 202, 205, 206, and 209. The set of prediction coefficients is composed of coefficients that are prepared for each LSP order with respect to each amplifier 202, 205, 206, and 209.

Adder 211 adds each vector from amplifiers 202, 205, 206, and 209 and outputs the result to subtracter 213. The output of adder 211 is outputted as a quantized wideband LSP parameter to delay device 212 and to an external unit of the scalable encoding apparatus shown in FIG. 2. The quantized wideband LSP parameter that is outputted to the external unit of the scalable encoding apparatus of FIG. 2 is used in a routine of another block or the like (not shown) for encoding a voice signal. When the parameter (code vector and prediction coefficient set outputted from each codebook) for that minimizes the error is determined by error minimizing section 214 described hereinafter, the vector that is then outputted from adder 211 becomes the quantized wideband LSP parameter. The quantized wideband LSP parameter is outputted to delay device 212. The output signal of adder 211 is indicated by Equation (2) below.

$$\hat{L}_W^{(n)}(i) = \alpha(i)\hat{C}^{(n)}(i) + \beta_1(i)\hat{L}_N^{(n)}(i) + \beta_2(i)\hat{L}_W^{(n-1)}(i) + \beta_3(i)\frac{\hat{L}_W^{(n-1)}(i)}{\hat{L}_N^{(n-1)}(i)}\hat{L}_N^{(n)}(i) \tag{2}$$

wherein, i-th element of quantized wideband LSP in nth frame prediction coefficient $\alpha$ for i-th element of LSP i-th element of multistage-vector-quantized codebook output vector in nth frame prediction coefficient $\beta_1$ for i-th element of LSP prediction coefficient $\beta_2$ for i-th element of LSP prediction coefficient $\beta_3$ for i-th element of LSP i-th element of quantized narrowband LSP in nth frame When the LSP parameter outputted as the wideband quantized LSP parameter does not satisfy a stability condition (the n-th LSP element is larger than any of the LSP element of 0 to (n−1)-th, i.e., the values of the LSP elements increase in the sequence of elements), adder 211 continues to operate so that the LSP stability condition is satisfied. When the interval of adjacent elements of quantized LSP is narrower than a prescribed interval, adder 211 also operates so that the interval is a prescribed interval or larger.

Subtracter 213 calculates the error between an externally inputted (obtained by analyzing the wideband signal) wideband LSP parameter as a quantization target, and a quantized LSP parameter candidate (quantized wideband LSP) inputted from adder 211, and outputs the calculated error to error minimizing section 214. The error calculation may be the square error between the inputted LSP vectors. When weighting is performed according to the characteristics of the inputted LSP vectors, the sound quality can be further improved. For example, the error is minimized using the weighted square error (weighted Euclid distance) of Equation (21) in chapter 3.2.4 (Quantization of the LSP coefficients) in ITU-T recommendation G.729.

Error minimizing section 214 selects, from multistage vector quantization codebook 208 and prediction coefficient table 210, the prediction coefficient set and the code vector, respectively, of each codebook for which the error outputted from subtracter 213 is minimized. The selected parameter information is encoded and outputted as encoded data.

Figure 3:
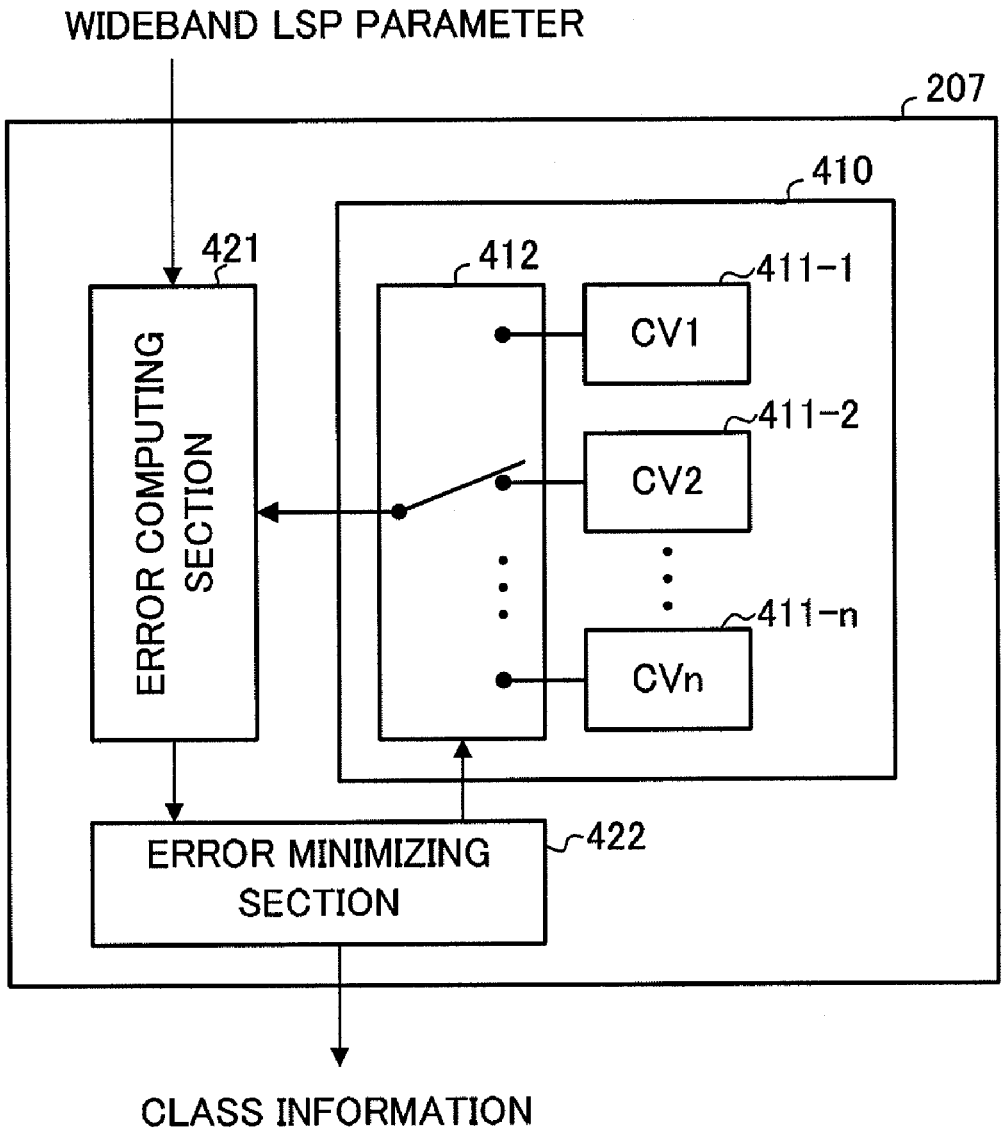
FIG. 3 is a block diagram showing the overall structure of the classifier in Embodiment 1.

FIG. 3 is a block diagram showing the overall structure of classifier 207. Classifier 207 is provided with error computing section 421, error minimizing section 422, and classification codebook 410 that has a number n of code vector (CV) storage sections 411 and switching device 412.

The number of CV storage sections 411 provided is equal to the number of classes classified in classifier 207, i.e., n. Each CV 411-1 through 411-n stores a code vector that corresponds to a classified class, and when a connection to error computing section 421 is made by switching device 412, the stored code vector is inputted to error computing section 421 via switching device 412.

Switching device 412 sequentially switches CV storage sections 411 that are connected to error computing section 421 according to an instruction from error minimizing section 422, and inputs every CV1 through CVn to error computing section 421.

Error computing section 421 sequentially computes the square error between the converted wideband LSP parameter inputted from narrowband-to-wideband converting section 200 and the CVk (k=1 to n) inputted from sorting codebook 410, and inputs the result to error minimizing section 422. Error computing section 421 may compute the square error on the basis of the Euclid distance of the vectors, or may compute the square error on the basis of the Euclid distance of pre-weighted vectors.

Error minimizing section 422 issues an instruction to switching device 412 so that CV(k+1) is inputted from classification codebook 410 to error computing section 421 at each time when the square error between the CVk and the converted wideband LSP parameter is inputted from error computing section 421, and Error minimizing section 422 also stores the square errors for CV1 through CVn and generates the class information that corresponds to the smallest square error among the stored square errors. Finally error minimizing section 422 inputs the class information to selecting switch 251.

The scalable encoding apparatus according to the present embodiment was described in detail above.

Figure 4:
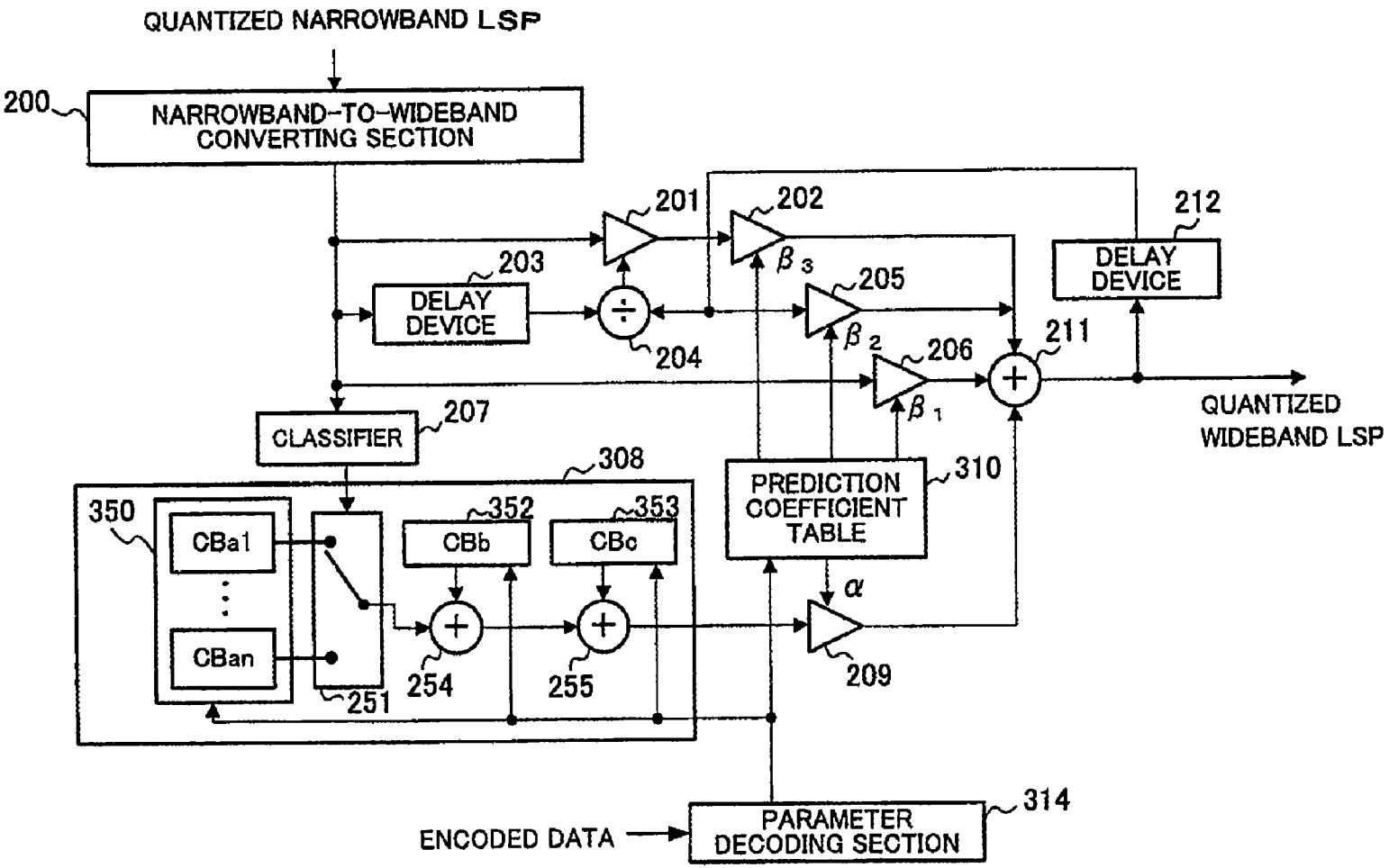
FIG. 4 is a block diagram showing the overall structure of the scalable decoding apparatus according to Embodiment 1.

FIG. 4 is a block diagram showing the overall structure of the scalable decoding apparatus that decodes the encoded data that were encoded by the above-mentioned scalable encoding apparatus. The scalable decoding apparatus performs the same operations as the scalable encoding apparatus shown in FIG. 2, except for the operations that relate to decoding the encoded data. Constituent elements that perform the same operations as those of the scalable encoding apparatus shown in FIG. 2 are indicated by the same reference numerals, and no description thereof is given.

The scalable decoding apparatus is provided with narrowband-to-wideband converting section 200, amplifier 201, amplifier 202, delay device 203, divider 204, amplifier 205, amplifier 206, classifier 207, multistage vector quantization codebook 308, amplifier 209, prediction coefficient table 310, adder 211, delay device 212, and parameter decoding section 314. Multistage vector quantization codebook 308 is provided with a first-stage codebook 350, selecting switch 251, second-stage codebook (CBb) 352, third-stage codebook (CBc) 353, and adders 254, 255.

Parameter decoding section 314 receives the encoded data encoded by the scalable encoding apparatus of the present embodiment and outputs the information indicating the code vector that is to be outputted by the codebooks 350, 352 and 353 of multistage vector quantization (VQ) codebook 308, and the prediction coefficient set to be outputted by the prediction coefficient table 310, to each of the codebooks and table.

First-stage codebook 350 retrieves, from the sub-codebooks (Cba1 through CBan) selected by selecting switch 251, the code vector indicated by the information inputted from parameter decoding section 314, and outputs the code vector to adder 254 via selecting switch 251.

Second-stage codebook 352 retrieves the code vector indicated by the information that is inputted from parameter decoding section 314, and outputs the code vector to adder 254.

Third-stage codebook 353 retrieves the code vector indicated by the information that is inputted from parameter decoding section 314, and outputs the code vector to adder 255.

Prediction coefficient table 310 retrieves the prediction coefficient set indicated by the information that is inputted from parameter decoding section 314, and outputs the corresponding prediction coefficients to amplifiers 202, 205, 206, and 209.

The code vector and prediction coefficient set stored by multistage VQ codebook 308 and prediction coefficient table 310 herein are the same as those of multistage VQ codebook 208 and prediction coefficient table 210 in the scalable encoding apparatus shown in FIG. 2. The operations thereof are also the same. The only difference in the configuration is that the component that sends an instruction to the multistage VQ codebook and the prediction coefficient table is error minimizing section 214 or parameter decoding section 314.

The output of adder 211 is outputted as a quantized wideband LSP parameter to an external unit of the scalable decoding apparatus of FIG. 4 and to delay device 212. The quantized wideband LSP parameter that is outputted to the external unit of the scalable decoding apparatus in FIG. 4 is used in the routine of a block or the like for decoding a voice signal.

The scalable decoding apparatus according to the present embodiment was described in detail above.

In the present embodiment as described above, the narrowband quantized LSP parameter that is decoded in the current frame is used to adaptively encode the wideband LSP parameter in the current frame. Specifically, quantized wideband LSP parameters are classified, a sub-codebook (CBa1 through CBan) dedicated for each class is prepared, the sub-codebooks are switched and used according to the classification results, and vector quantization of the wideband LSP parameters is performed. By adopting the configuration, according to the present embodiment, it is possible to perform encoding that is suited for quantization of a wideband LSP parameter on the basis of already quantized narrowband LSP information, and to improve the performance of wideband LSP parameter quantization.

According to the present embodiment, since the above-mentioned classification is performed using a quantized narrowband LSP parameter for which encoding (decoding) is already completed, it is not necessary, for example, to separately acquire class information in the decoding side from the encoding side. Specifically, according to the present embodiment, it is possible to improve the performance of wideband LSP parameter encoding without increasing the transmission rate of communication.

In the present embodiment, the first-stage codebooks 250, 350 in multistage vector quantization codebooks 208, 308 that include the sub-codebooks (CBa1 through CBan) are designed in advance to represent the basis characteristics of the encoding subject. For example, average components, bias components, and other components in multistage vector quantization codebooks 208, 308 are all reflected or otherwise indicated in first-stage codebooks 250, 350 so that stages subsequent to the second stage become encoding of noise-like error components. By so doing, since the average energy of the code vectors of first-stage codebooks 250, 350 increases relative to stages subsequent to the second stage, the main components of the vectors generated by multistage vector quantization codebooks 208, 308 can be expressed by first-stage codebooks 250, 350.

In the present embodiment, first-stage codebooks 250, 350 are the only codebooks that switch sub-codebooks according to classification in classifier 207. Specifically, only the first-stage codebook, in which the average energy of the stored vectors is the largest, comprises the sub-codebook. The amount of memory needed to store the code vectors can thereby be reduced in comparison to a case in which all of the codebooks of multistage vector quantization codebooks 208, 308 are switched for each class. Furthermore, a significant switching effect can thereby be obtained by merely switching first-stage codebooks 250, 350, and the performance of wideband LSP parameter quantization can be effectively improved.

A case was described in which error computing section 421 computed the square error between the wideband LSP parameter and the code vector from classification codebook 410, and error minimizing section 422 stored the square error and selected the minimum error in the present embodiment. However, it is not strictly necessary that the aforementioned square error be computed insofar as the type of routine performed has the equivalent effect of selecting the minimum error between the wideband LSP parameter and the code vector. A portion of the aforementioned square error computation may also be omitted to reduce the amount of computation, and the routine may select the vector that produces a quasi-minimum error.

Embodiment 2

Figure 5:
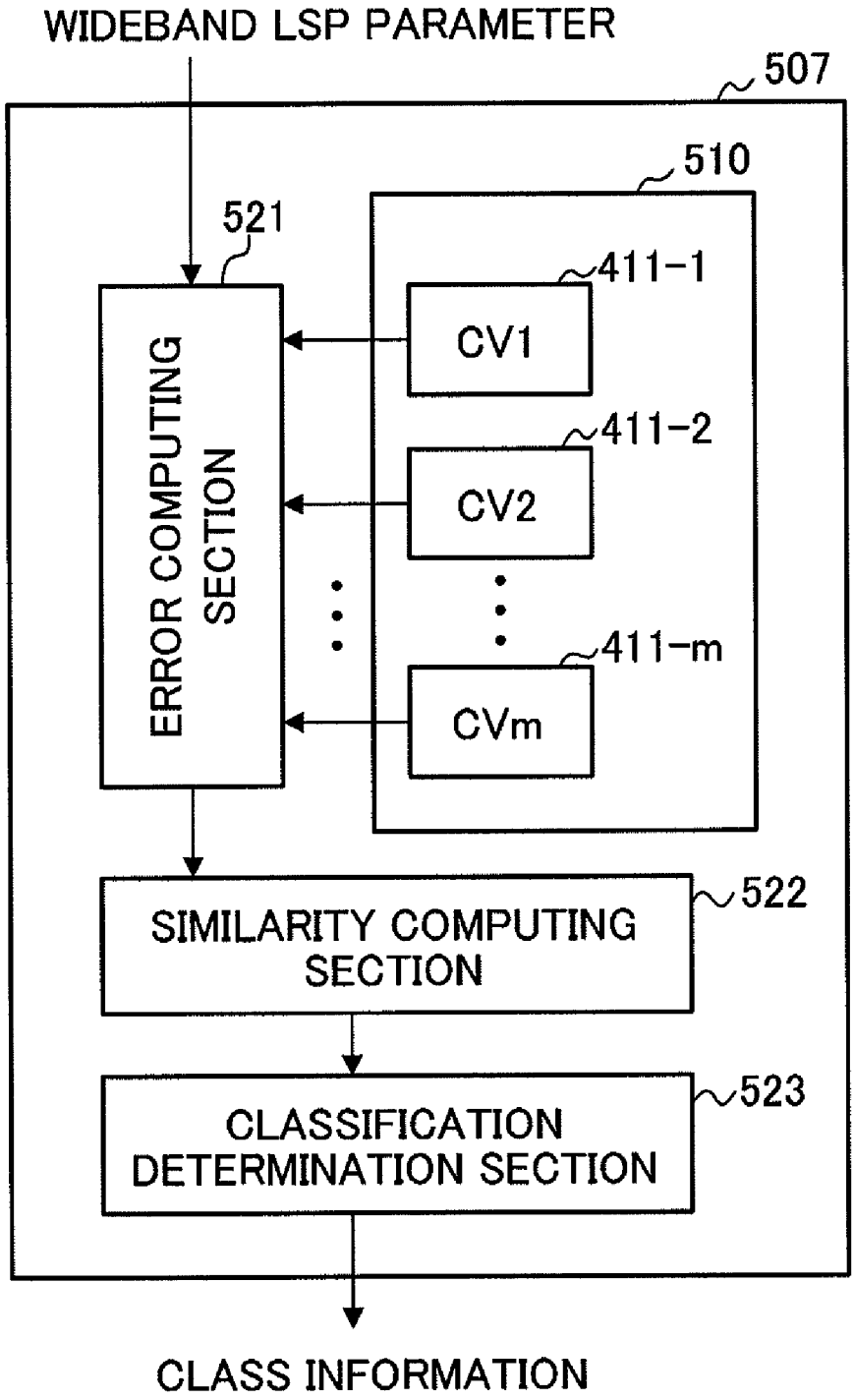
FIG. 5 is a block diagram showing the overall structure of the classifier in Embodiment 2.

FIG. 5 is a block diagram showing the overall structure of classifier 507 that is provided to the scalable encoding apparatus or scalable decoding apparatus according to Embodiment 2 of the present invention. The scalable encoding apparatus or scalable decoding apparatus according to the present embodiment is provided with classifier 507 instead of classifier 207 in the scalable encoding apparatus or scalable decoding apparatus according to Embodiment 1. Accordingly, almost all of the constituent elements of the scalable encoding apparatus or scalable decoding apparatus according to the present embodiment perform the same functions as the constituent elements of the scalable encoding apparatus or scalable decoding apparatus according to Embodiment 1. Therefore, constituent elements that perform the same functions are indicated by the same reference numerals as in Embodiment 1 to prevent redundancy, and no descriptions thereof will be given.

Classifier 507 is provided with error computing section 521, similarity computing section 522, classification determination section 523, and classification codebook 510 that has a number of m CV storage sections 411.

Classification codebook 510 simultaneously inputs to error computing section 521 m types of CV stored by CV storage sections 411-1 through 411-m, respectively.

Error computing section 521 computes the square error between a converted wideband LSP parameter inputted from narrowband-to-wideband converting section 200 and a CVk (k=1 to m) inputted from classification codebook 510, and inputs all of the m computed square errors to similarity computing section 522. Error computing section 521 may compute the square error on the basis of the Euclid distance of the vectors, or may compute the square error on the basis of the Euclid distance of pre-weighted vectors.

Similarity computing section 522 computes the similarity between the converted wideband LSP parameter that is inputted to error computing section 521 and the CV1 through CVm that are inputted from classification codebook 510 on the basis of the m square errors inputted from error computing section 521, and inputs the computed similarities to classification determination section 523. Specifically, similarity computing section 522 performs scalar quantization of each of them square errors inputted from error computing section 521 into a number K of ranks from the lowest similarity "0" to the highest similarity "K−1," for example, and converts the m square errors to similarities k(i), where i=0 to (K−1).

Classification determination section 523 performs classification using the similarities k(i) (where i=0 to (K−1)) inputted from similarity computing section 522, generates class information that indicates the determined class, and inputs the class information to selecting switch 251. Classification determination section 523 herein uses Equation (3), for example, to perform classification.

$$\sum_{i=1}^{m} K^{i-1} k(i) \tag{3}$$

According to the present embodiment, since the similarities are computed in similarity computing section 522 from the results of scalar quantization of m square errors, it is possible to reduce the amount of complexity for the computation. Further, according to the present embodiment, the n square errors are converted to similarities that are indicated by a number of ranks equal to K in similarity computing section 522. Therefore, the number of classes classified by classifier 507 can be increased even when there are a small number of m types of CV storage sections 411. In other words, according to the present embodiment, it is possible to reduce the amount of memory used to store code vectors in sorting codebook 510 without reducing the quality of the class information that is inputted from classifier 507 to selecting switch 251.

Embodiment 3

Figure 6:
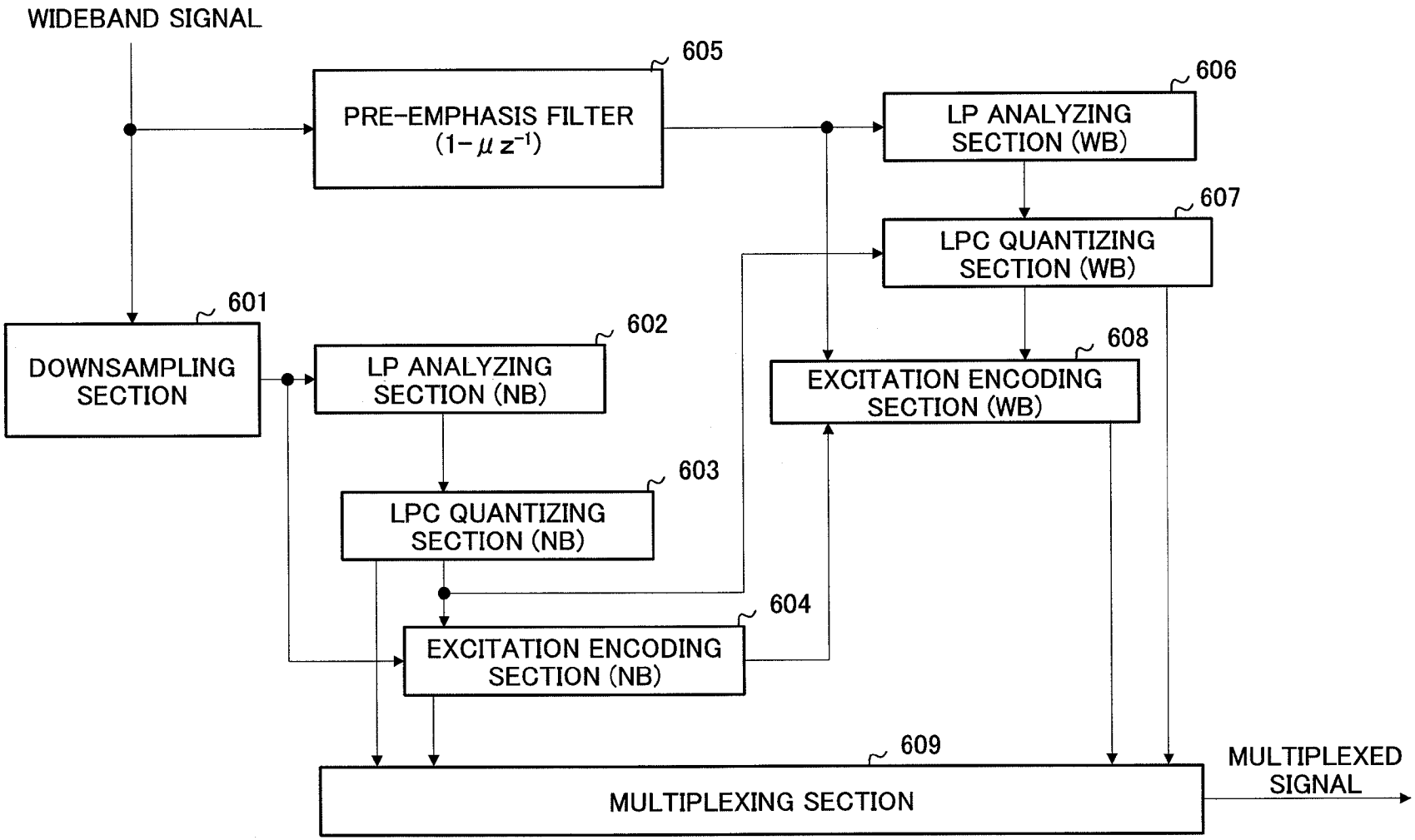
FIG. 6 is a block diagram showing the overall structure of the scalable voice encoding apparatus according to Embodiment 3.

FIG. 6 is a block diagram showing the overall structure of the scalable voice encoding apparatus according to Embodiment 3 of the present invention.

The scalable voice encoding apparatus of the present embodiment is provided with downsampling section 601, LP analyzing section (NB) 602, LPC quantizing section (NB) 603, excitation encoding section (NB) 604, pre-emphasis filter 605, LP analyzing section (WB) 606, LPC quantizing section (WB) 607, excitation encoding section (WB) 608, and multiplexing section 609.

Downsampling section 601 performs a general downsampling routine that is a combination of decimation and LPF (low-pass filter) processing for an inputted wideband signal, and outputs a narrowband signal to LP analyzing section (NB) 602 and to excitation encoding section (NB) 604.

LP analyzing section (NB) 602 performs linear prediction analysis of the narrowband signal inputted from downsampling section 601 and outputs a set of linear prediction coefficients to LPC quantizing section (NB) 603.

LPC quantizing section (NB) 603 quantizes the set of linear prediction coefficients inputted from LP analyzing section (NB) 602, outputs encoded information to multiplexing section 609, and outputs a set of quantized linear prediction coefficients to LPC quantizing section (WB) 607 and excitation encoding section (NB) 604. LPC quantizing section (NB) 603 herein performs quantization processing after converting the set of linear prediction coefficients to an LSP (LSF) or other spectral parameter.

The quantized linear prediction parameter outputted from LPC quantizing section (NB) 603 may be a spectral parameter or a set of linear prediction coefficients.

Excitation encoding section (NB) 604 converts the linear prediction parameter inputted from LPC quantizing section (NB) 603 to a set of linear prediction coefficients and constructs a linear prediction filter that is based on the obtained set of linear prediction coefficients. The excitation signal driving the linear prediction filter is encoded so as to minimize the error between the signal synthesized by the constructed linear prediction filter and the narrowband signal inputted from downsampling section 601; the excitation encoded information is outputted to multiplexing section 609; and a decoded excitation signal (quantized excitation signal) is outputted to excitation encoding section (WB) 608.

Pre-emphasis filter 605 performs high-band enhancement processing (where the transmission function $1-\mu z^{-1}$, wherein $\mu$ is a filter coefficient, and $z^{-1}$ is a complex variable referred to as a delay operator in the z conversion) of the inputted wideband signal, and outputs the result to LP analyzing section (WB) 606 and excitation encoding section (WB) 608.

LP analyzing section (WB) 606 performs linear prediction analysis of the pre-emphasized wideband signal inputted from pre-emphasis filter 605, and outputs a set of linear prediction coefficients to LPC quantizing section (WB) 607.

LPC quantizing section (WB) 607 converts the set of linear prediction coefficients inputted from LP analyzing section (WB) 606 into an LSP (LSF) or other spectral parameter; uses, e.g., the scalable encoding apparatus described hereinafter to perform quantization processing of the linear prediction parameter (wideband) by using the obtained spectral parameter and a quantized linear prediction parameter (narrowband) that is inputted from LPC quantizing section (NB) 603; outputs encoded information to multiplexing section 609; and outputs the quantized linear prediction parameter to excitation encoding section (WB) 608.

Excitation encoding section (WB) 608 converts the quantized linear prediction parameter inputted from LPC quantizing section (WB) 607 into a set of linear prediction coefficients, and constructs a linear prediction filter that is based on the obtained set of linear prediction coefficients. The excitation signal driving the linear prediction filter is encoded so as to minimize the error between the signal synthesized by the constructed linear prediction filter and the wideband signal inputted from pre-emphasis filter 605, and the excitation encoded information is outputted to multiplexing section 609. Excitation encoding of the wideband signal can be performed efficiently by utilizing the decoded excitation signal (quantized excitation signal) of the narrowband signal inputted from excitation encoding section (NB) 604.

Multiplexing section 609 multiplexes various types of encoded information inputted from LPC quantizing section (NB) 603, excitation encoding section (NB) 604, LPC quantizing section (WB) 607, and excitation encoding section (WB) 608, and transmits a multiplexed signal to a transmission channel.

Figure 7:
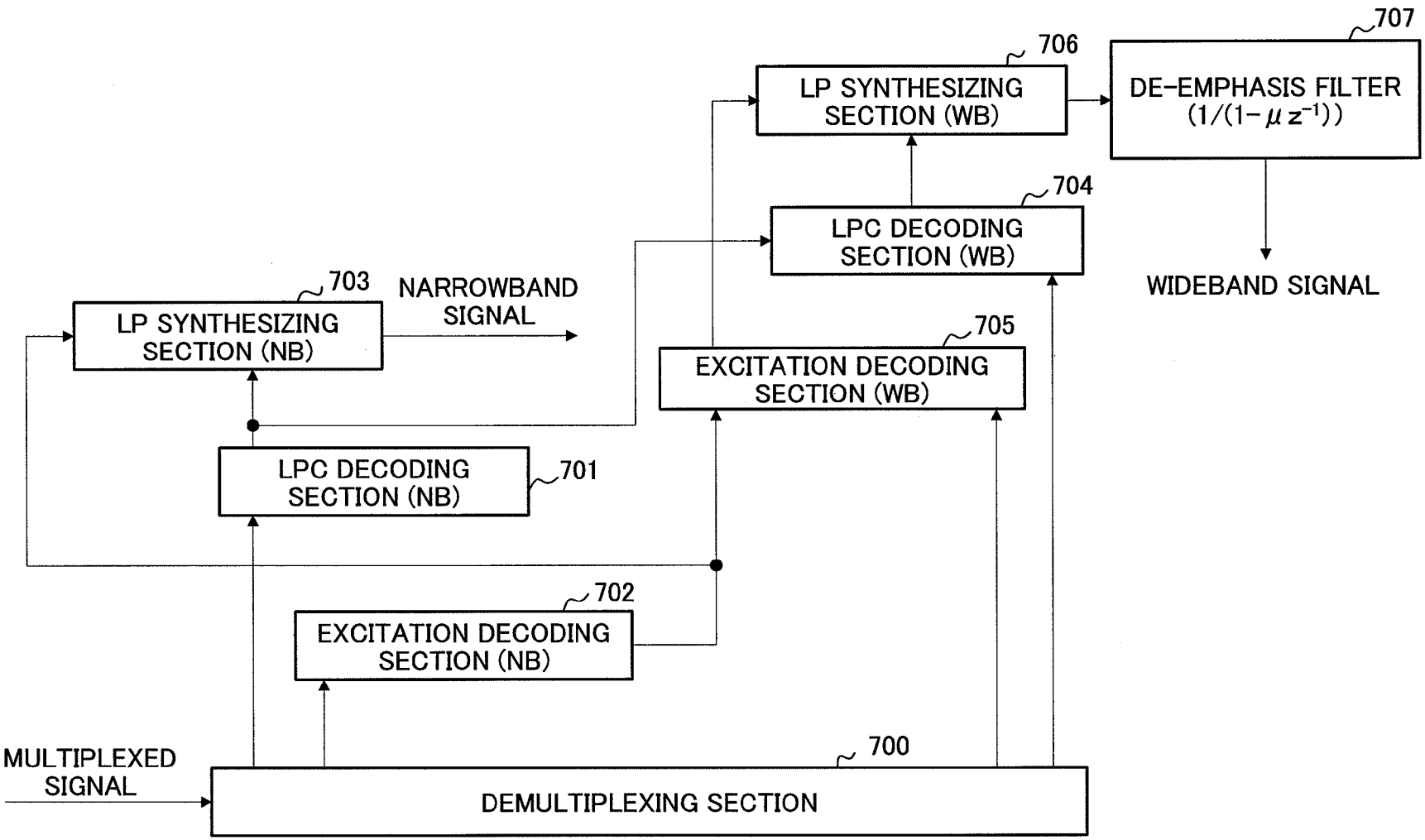
FIG. 7 is a block diagram showing the overall structure of the scalable voice decoding apparatus according to Embodiment 3.

FIG. 7 is a block diagram showing the overall structure of the scalable voice decoding apparatus according to Embodiment 3 of the present invention.

The scalable voice decoding apparatus of the present embodiment is provided with demultiplexing section 700, LPC decoding section (NB) 701, excitation decoding section (NB) 702, LP synthesizing section (NB) 703, LPC decoding section (WB) 704, excitation decoding section (WB) 705, LP synthesizing section (WB) 706, and de-emphasis filter 707.

Demultiplexing section 700 receives a multiplexed signal transmitted from the scalable voice encoding apparatus according to the present embodiment; separates each type of encoded information; and outputs quantized narrowband linear prediction coefficient encoded information to LPC decoding section (NB) 701, narrowband excitation encoded information to excitation decoding section (NB) 702, quantized wideband linear prediction coefficient encoded information to LPC decoding section (WB) 704, and wideband excitation encoded information to excitation decoding section (WB) 705.

LPC decoding section (NB) 701 decodes the quantized narrowband linear prediction encoded information that is inputted from demultiplexing section 700, decodes the set of quantized narrowband linear prediction coefficients, and outputs the result to LP synthesizing section (NB) 703 and LPC decoding section (WB) 704. However, as described in the case of the scalable voice encoding apparatus, since quantization is performed with the set of linear prediction coefficients converted to an LSP (or an LSF), the information obtained from the decoding is not a set of linear prediction coefficients as such, but is an LSP parameter. The decoded LSP parameter is outputted to LP synthesizing section (NB) 703 and LPC decoding section (WB) 704.

Excitation decoding section (NB) 702 decodes the narrowband excitation encoded information that is inputted from demultiplexing section 700, and outputs the result to LP synthesizing section (NB) 703 and excitation decoding section (WB) 705.

LP synthesizing section (NB) 703 converts the decoded LSP parameter inputted from LPC decoding section (NB) 701 into a set of linear prediction coefficients, uses the set of linear prediction coefficients to construct a linear prediction filter, and generates a narrowband signal using the decoded narrowband excitation signal inputted from excitation decoding section (NB) 702 as the excitation signal driving the linear prediction filter.

LPC decoding section (WB) 704 uses the scalable decoding apparatus described hereinafter, for example, to decode the wideband LSP parameter by using the quantized wideband linear prediction coefficient encoded information that is inputted from demultiplexing section 700 and the narrowband decoded LSP parameter that is inputted from LPC decoding section (NB) 701, and outputs the result to LP synthesizing section (WB) 706.

Excitation decoding section (WB) 705 decodes the wideband excitation signal using the wideband excitation encoded information inputted from demultiplexing section 700 and the decoded narrowband excitation signal inputted from excitation decoding section (NB) 702, and outputs the result to LP synthesizing section (WB) 706.

LP synthesizing section (WB) 706 converts the decoded wideband LSP parameter inputted from LPC decoding section (WB) 704 into a set of linear prediction coefficients, uses the set of linear prediction coefficients to construct a linear prediction filter, generates a wideband signal by using the decoded wideband excitation signal inputted from excitation decoding section (WB) 705 as the excitation signal driving the linear prediction filter, and outputs the wideband signal to de-emphasis filter 707.

De-emphasis filter 707 is a filter whose characteristics are inverse of pre-emphasis filter 605 of the scalable voice encoding apparatus. A de-emphasized signal is outputted as a decoded wideband signal.

A signal obtained by up-sampling the narrowband signal generated by LP synthesizing section (NB) 703 may be used as the low-band components to decode the wideband signal. In this case, a wideband signal outputted from de-emphasis filter 707 may be passed through a high-pass filter that has appropriate frequency characteristics, and added to the aforementioned up-sampled narrowband signal. The narrowband signal may also be passed through a post filter to improve auditory quality.

Figure 8:
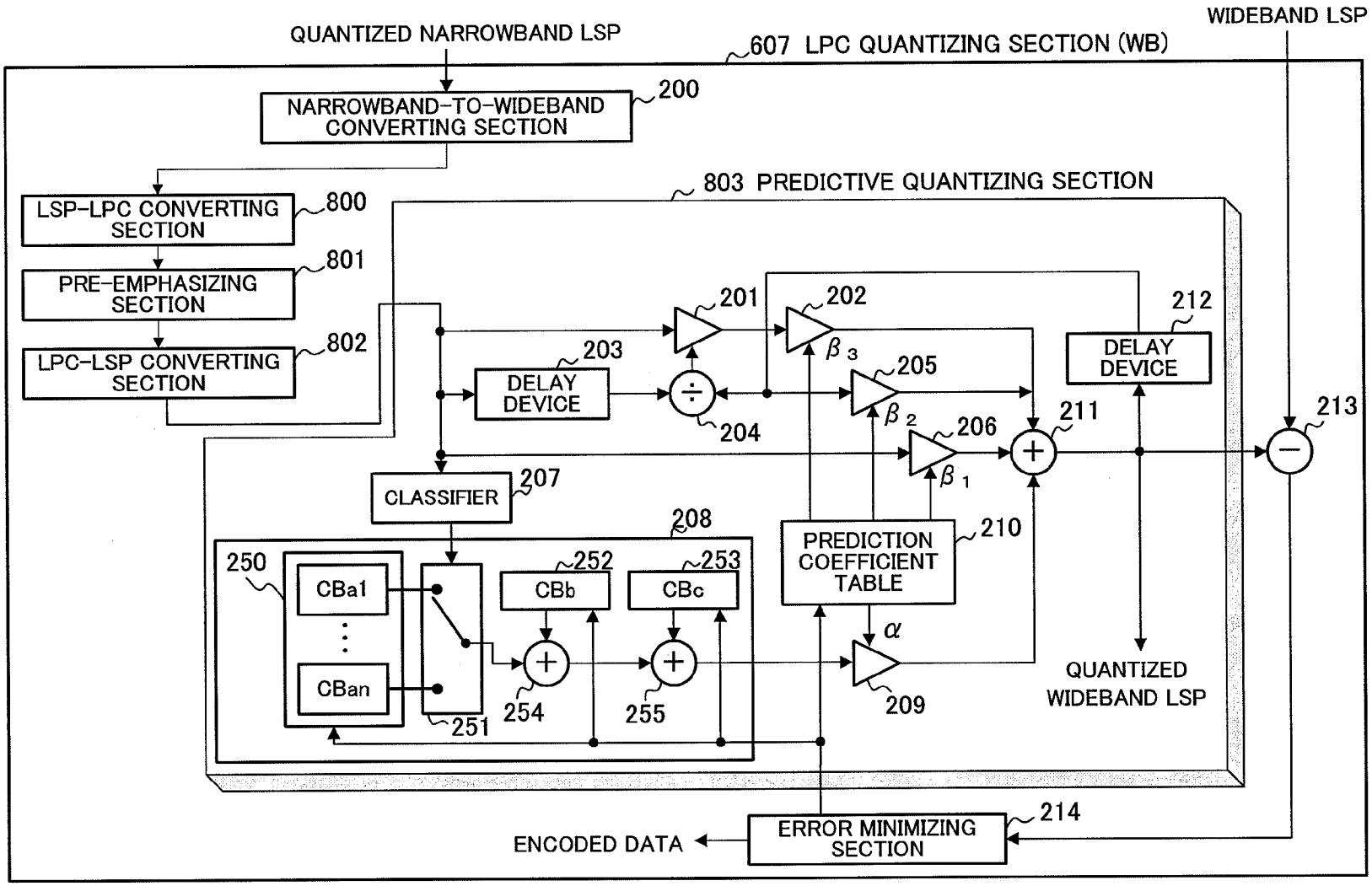
FIG. 8 is a block diagram showing the overall structure of the LPC quantizing section (WB) in Embodiment 3.

FIG. 8 is a block diagram showing the overall structure of LPC quantizing section (WB) 607. LPC quantizing section (WB) 607 is provided with narrowband-to-wideband converting section 200, LSP-LPC converting section 800, pre-emphasizing section 801, LPC-LSP converting section 802, and prediction quantizing section 803. Prediction quantizing section 803 is provided with amplifier 201, amplifier 202, delay device 203, divider 204, amplifier 205, amplifier 206, classifier 207, multistage vector quantization codebook 208, amplifier 209, prediction coefficient table 210, adder 211, delay device 212, subtracter 213, and error minimizing section 214. Multistage vector quantization codebook 208 is provided with first-stage codebook 250, selecting switch 251, second-stage codebook (CBb) 252, third-stage codebook (CBc) 253, and adders 254, 255.

The scalable encoding apparatus (LPC quantizing section (WB) 607) shown in FIG. 8 is composed of the scalable encoding apparatus shown in FIG. 2, with LSP-LPC converting section 800, pre-emphasizing section 801, and LPC-LSP converting section 802 added thereto. Accordingly, almost all of the components provided to the scalable encoding apparatus according to the present embodiment perform the same functions as the constituent elements of the scalable encoding apparatus of Embodiment 1. Therefore, constituent elements that perform the same functions are indicated by the same reference numerals as in Embodiment 1 to prevent redundancy, and no descriptions thereof will be given.

The quantized linear prediction parameter (quantized narrowband LSP herein) inputted from LPC quantizing section (NB) 603 is converted to a wideband LSP parameter in narrowband-to-wideband converting section 200, and the converted wideband LSP parameter (quantized narrowband LSP parameter converted to wideband form) is outputted to LSP-LPC converting section 800.

LSP-LPC converting section 800 converts the converted wideband LSP parameter (quantized linear prediction parameter) inputted from narrowband-to-wideband converting section 200 to a linear prediction coefficient (quantized narrowband LPC), and outputs a set of linear predication coefficients to pre-emphasizing section 801.

Pre-emphasizing section 801 uses a type of method described hereinafter to compute a pre-emphasized set of linear prediction coefficients from the set of linear prediction coefficients inputted from LSP-LPC converting section 800, and outputs the pre-emphasized set of linear prediction coefficients to LPC-LSP converting section 802.

LPC-LSP converting section 802 converts the pre-emphasized set of linear prediction coefficients inputted from pre-emphasizing section 801 to a pre-emphasized quantized narrowband LSP, and outputs the pre-emphasized quantized narrowband LSP to predictive quantizing section 803.

Predictive quantizing section 803 converts the pre-emphasized quantized narrowband LSP inputted from LPC-LSP converting section 802 to a quantized wideband LSP, and outputs the quantized wideband LSP to predictive quantizing section 803. Predictive quantizing section 803 may have any configuration insofar as a quantized wideband LSP is outputted, and 201 through 212 shown in FIG. 2 of Embodiment 1 are used as constituent elements in the example of the present embodiment.

Figure 9:
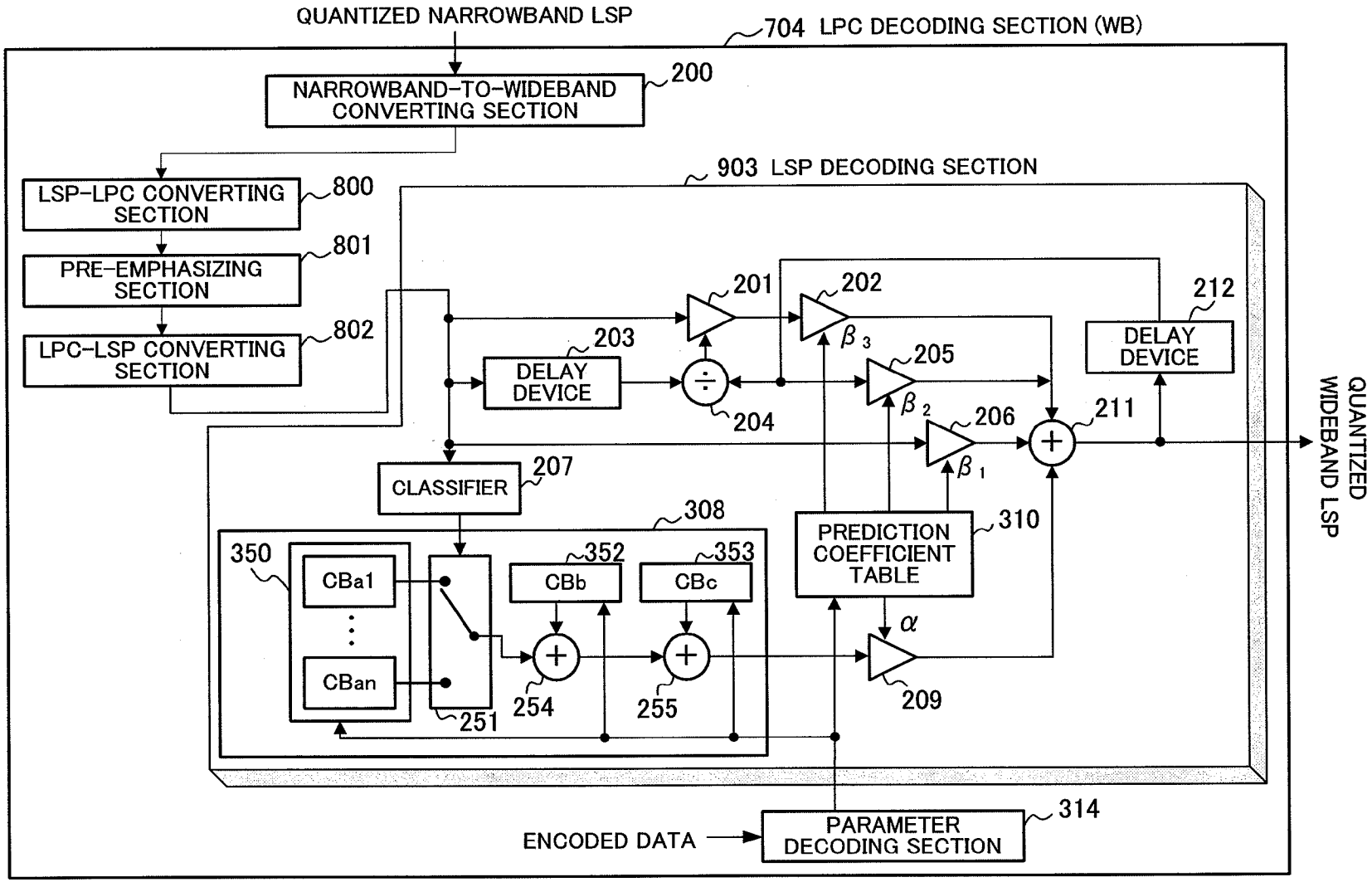
FIG. 9 is a block diagram showing the overall structure of the LPC decoding section (WB) in Embodiment 3.

FIG. 9 is a block diagram showing the overall structure of LPC decoding section (WB) 704. LPC decoding section (WB) 704 is provided with narrowband-to-wideband converting section 200, LSP-LPC converting section 800, pre-emphasizing section 801, LPC-LSP converting section 802, and LSP decoding section 903. LSP decoding section 903 is provided with amplifier 201, amplifier 202, delay device 203, divider 204, amplifier 205, amplifier 206, classifier 207, multistage vector quantization codebook 308, amplifier 209, prediction coefficient table 310, adder 211, delay device 212, and parameter decoding section 314. Multistage vector quantization codebook 308 is provided with first-stage codebook 350, selecting switch 251, second-stage codebook (CBb) 352, third-stage codebook (CBc) 353, and adders 254, 255.

The scalable decoding apparatus (LPC decoding section (WB) 704) shown in FIG. 9 is composed of the scalable decoding apparatus shown in FIG. 4, with LSP-LPC converting section 800, pre-emphasizing section 801, and LPC-LSP converting section 802 shown in FIG. 8 added thereto. Accordingly, almost all of the components provided to the scalable voice decoding apparatus according to the present embodiment perform the same functions as the constituent elements of the scalable decoding apparatus of Embodiment 1. Therefore, constituent elements that perform the same functions are indicated by the same reference numerals as in Embodiment 1 to prevent redundancy, and no descriptions thereof will be given.

The quantized narrowband LSP inputted from LPC decoding section (NB) 701 is converted to a wideband LSP parameter in narrowband-to-wideband converting section 200, and the converted wideband LSP parameter (quantized narrowband LSP parameter converted to wideband form) is outputted to LSP-LPC converting section 800.

LSP-LPC converting section 800 converts the converted wideband LSP parameter (quantized narrowband LSP after conversion) inputted from narrowband-to-wideband converting section 200 to a set of linear prediction coefficients (quantized narrowband LPC), and outputs the set of linear prediction coefficients to pre-emphasizing section 801.

Pre-emphasizing section 801 uses a type of method described hereinafter to compute a pre-emphasized set of linear prediction coefficients from the set of linear prediction coefficients inputted from LSP-LPC converting section 800, and outputs the pre-emphasized set of linear prediction coefficients to LPC-LSP converting section 802.

LPC-LSP converting section 802 converts the pre-emphasized set of linear prediction coefficients inputted from pre-emphasizing section 801 to a pre-emphasized quantized narrowband LSP, and outputs the pre-emphasized quantized narrowband LSP to LSP decoding section 903.

LSP decoding section 903 converts the pre-emphasized decoded (quantized) narrowband LSP inputted from LPC-LSP converting section 802 to a quantized wideband LSP, and outputs the quantized wideband LSP to an external unit of LSP decoding section 903. LSP decoding section 903 may have any configuration insofar as LSP decoding section 903 outputs a quantized wideband LSP and outputs the same quantized wideband LSP as does predictive quantizing section 803. However, 201 through 207, 308, 209, 310, 211, and 212 shown in FIG. 4 of Embodiment 1 are used as constituent elements in the example of the present embodiment.

Figure 10:
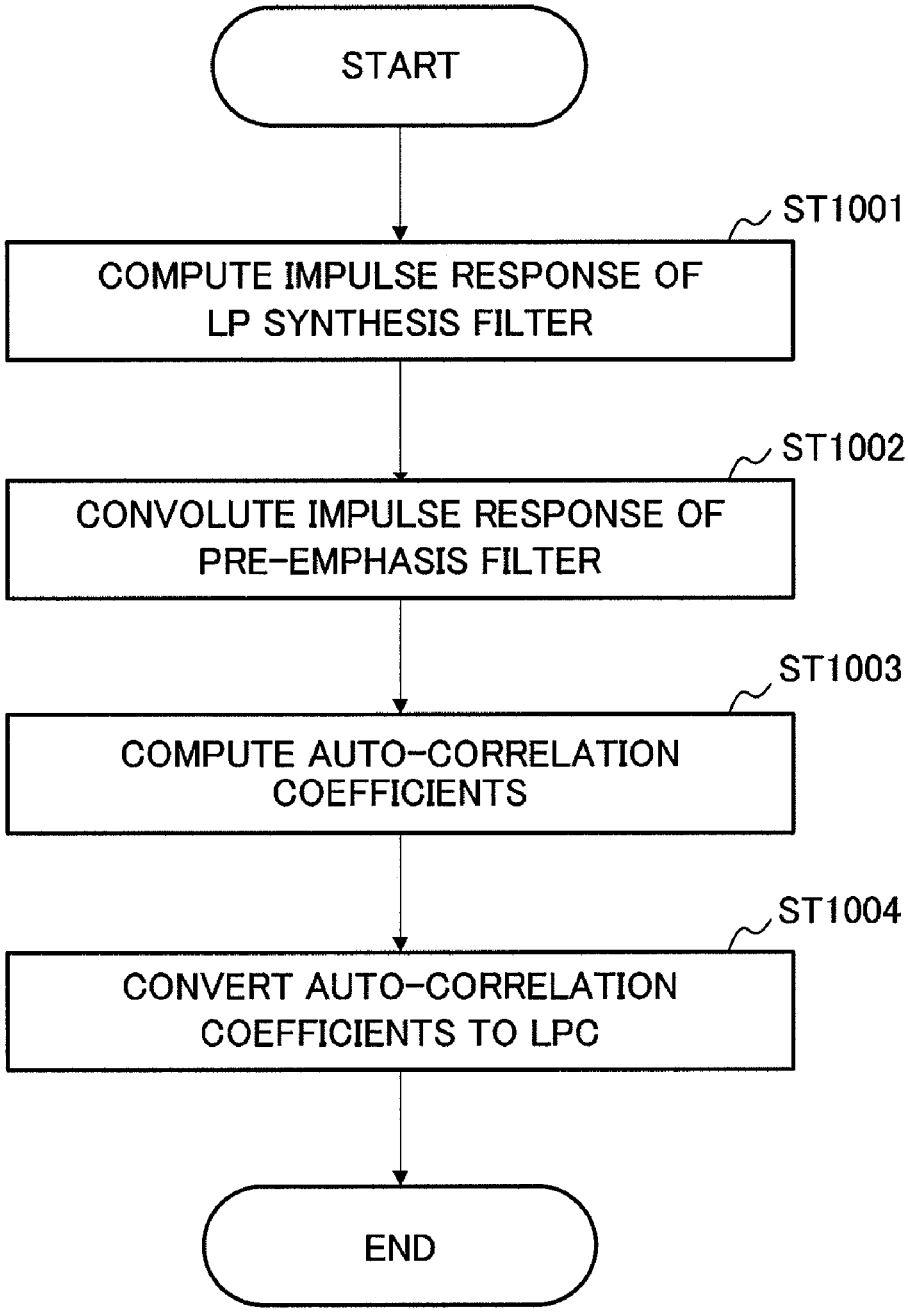
FIG. 10 is a flow diagram showing an example of the sequence of routines performed by the pre-emphasizing section in embodiment 3.

FIG. 10 is a flow diagram showing an example of the sequence of routines performed in pre-emphasizing section 801. In step (hereinafter abbreviated as "ST") 1001 shown in FIG. 10, the impulse response of the LP synthesis filter formed with the inputted quantized narrowband LPC is computed. In ST1002, the impulse response of pre-emphasis filter 605 is convolved with the impulse response computed in ST1001, and the "pre-emphasized impulse response of the LP synthesis filter" is computed.

In ST1003, the set of auto-correlation coefficients of the "pre-emphasized impulse response of the LP synthesis filter" computed in ST1002 is computed, and in ST1004, the set of auto-correlation coefficients is converted to a set of LPC, and the pre-emphasized quantized narrowband LPC is outputted.

Since pre-emphasis is processing for flattening a slope of a spectrum in advance in order to avoid the effects from the spectral slope, the processing performed in pre-emphasizing section 801 is not limited to the specific processing method shown in FIG. 10, and pre-emphasis may be performed according to another processing method.

In the present embodiment thus configured, the wideband LSF if predicted from the narrowband LSF with enhanced performance, and the quantization performance is improved by performing pre-emphasis processing. Voice encoding that is suited to human auditory characteristics is made possible, and the subjective quality of the encoded voice is improved particularly by introducing the type of pre-emphasis processing described above into a scalable voice encoding apparatus that has the structure shown in FIG. 6.

Embodiment 4

Figure 11:
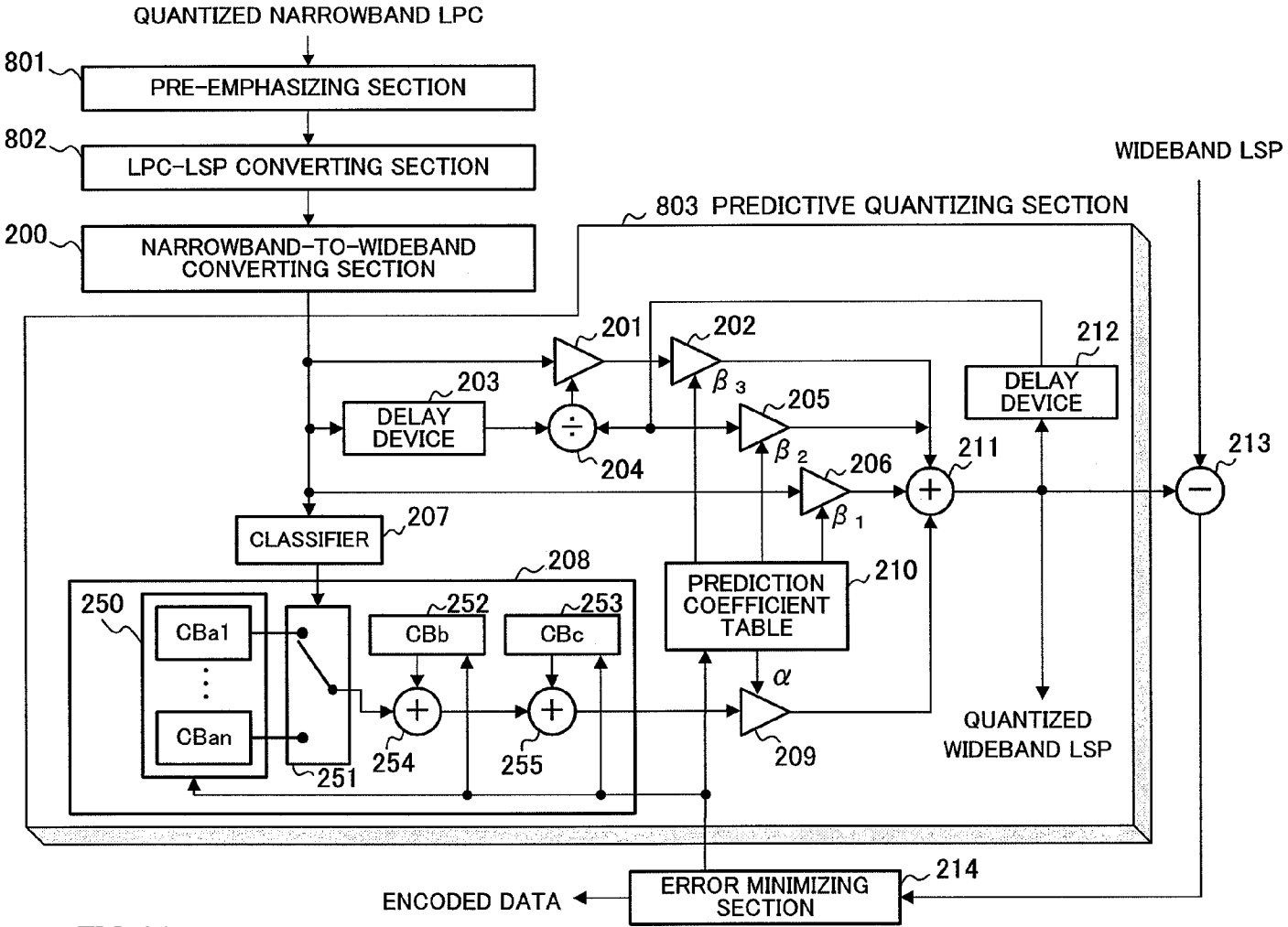
FIG. 11 is a block diagram showing the overall structure of the scalable encoding apparatus according to Embodiment 4.

FIG. 11 is a block diagram showing the overall structure of the scalable encoding apparatus according to Embodiment 4 of the present invention. The scalable encoding apparatus shown in FIG. 11 can be applied to LPC quantizing section (WB) 607 shown in FIG. 6. The operations of each block are the same as those shown in FIG. 8. Therefore, the operations have the same reference numbers, and no description thereof will be given. The operations of pre-emphasizing section 801 and LPC-LSP converting section 802 are the same, but are performed in a step prior to converting the inputted and outputted parameters from narrowband to wideband.

The differences between FIG. 8 of Embodiment 3 and FIG. 11 of the present embodiment are as described below. Pre-emphasis in the region of the narrowband signal (low sampling rate) is performed in FIG. 11, and pre-emphasis in the region of the wideband signal (high sampling rate) is performed in FIG. 8. The configuration shown in FIG. 11 has advantages in that the sampling rate is low, and the increase in the amount of computational complexity therefore remains small. The coefficient $\mu$ of pre-emphasis used in FIG. 8 is preferably adjusted in advance to an appropriate value (a value that may differ from $\mu$ of pre-emphasis filter 605 shown in FIG. 6).

In FIG. 11, since the quantized narrowband LPC (linear prediction coefficients) are inputted, the quantized linear prediction parameter outputted from LPC quantizing section (NB) 603 in FIG. 6 is a set of linear prediction coefficients rather than an LSP.

Figure 12:
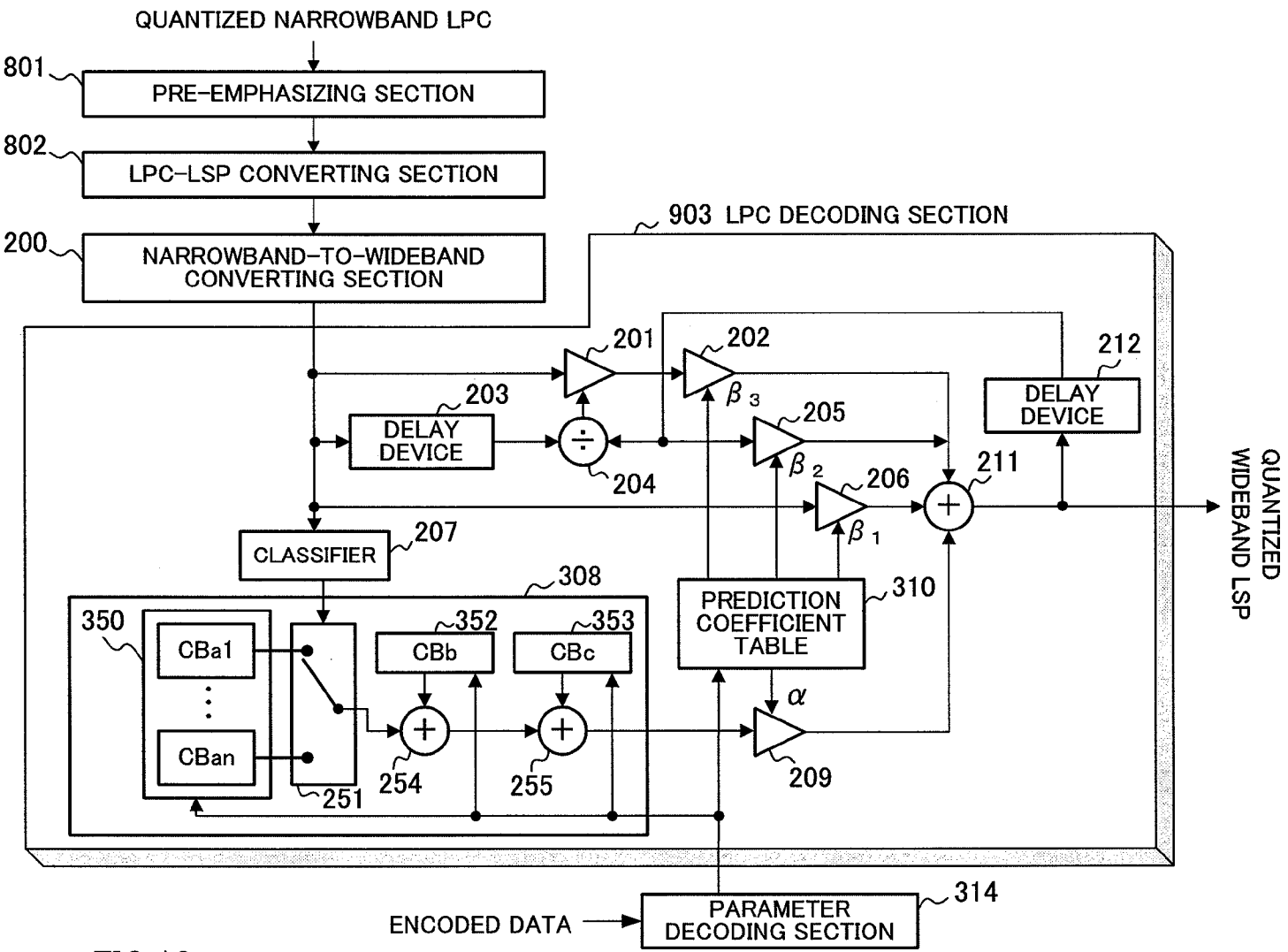
FIG. 12 is a block diagram showing the overall structure of the scalable decoding apparatus according to Embodiment 4.

FIG. 12 is a block diagram showing the overall structure of the scalable decoding apparatus according to Embodiment 4 of the present invention. The scalable decoding apparatus shown in FIG. 12 can be applied to LPC decoding section (WB) 704 shown in FIG. 7. The operations of each block are the same as those shown in FIG. 9. Therefore, the operations have the same reference numbers, and no description thereof will be given.

The operations of pre-emphasizing section 801 and LPC-LSP converting section 802 are also the same as those of FIG. 11, and no descriptions thereof will be given.

In FIG. 12, since the quantized narrowband LPC (linear prediction coefficients) are inputted, the quantized linear prediction parameter outputted from LPC decoding section (NB) 701 in FIG. 7 is a set of linear prediction coefficients rather than an LSP.

The differences between FIG. 9 of Embodiment 3 and FIG. 12 of the present embodiment are the same as the differences between FIG. 8 and FIG. 12 described above.

Embodiments of the present invention were described above.

The scalable encoding apparatus according to the present invention may be configured so that downsampling is not performed in downsampling section 601, and only bandwidth limitation filtering is performed. In this case, scalable encoding of a narrowband signal and a wideband signal is performed with the signal in the same sampling frequency but having different bandwidth, and processing by narrowband-to-wideband converting section 200 is unnecessary.

The scalable voice encoding apparatus according to the present invention is not limited by the above Embodiments 3 and 4 and may be modified in various ways. For example, the transmission coefficient of the pre-emphasis filter 605 used was $1-\mu z^{-1}$, but a configuration that uses a filter having other appropriate characteristics may also be adopted.

The scalable encoding apparatus and scalable decoding apparatus of the present invention are also not limited by the abovementioned Embodiments 1 through 4, and may also include various types of modifications. For example, it is also possible to adopt a configuration that omits some or all of constituent elements 212 and 201 through 205.

The scalable encoding apparatus and scalable decoding apparatus according to the present invention may also be mounted in a communication terminal apparatus and a base station apparatus in a mobile communication system. It is thereby possible to provide a communication terminal apparatus and base station apparatus that have the same operational effects as those described above.

A case was described herein of encoding/decoding of an LSP parameter, but the present invention may also be used with an ISP (Immittance Spectrum Pairs) parameter.

In the embodiments described above, the narrowband signal was a sound signal (generally a sound signal having the 3.4 kHz bandwidth) having a sampling frequency of 8 kHz, the wideband signal was a sound signal (e.g., sound signal having a bandwidth of 7 kHz with a sampling frequency of 16 kHz) having a wider bandwidth than the narrow band signal, and the signals were typically a narrowband voice signal and a wideband voice signal, respectively. However, the narrowband signal and the wideband signal are not necessarily limited to the abovementioned signals.

In the examples described herein, a vector quantization method was used as a classification method that used a narrowband quantized LSP parameter of the current frame, but a conversion to a reflection coefficient, a logarithmic cross-sectional area ratio, or other parameter may be performed, and the parameter may be used for classification.

When the abovementioned classification is used in a vector quantization method, the classification may be performed only for limited lower order elements without using all the elements of a quantized LSP parameter. Alternatively, classification may be performed after the quantized LSP parameter is converted to one with a lower order. The additional amount of computational complexity and memory requirements for introducing classification can thereby be kept from increasing.

The structure of codebooks in the multistage vector quantization had three stages herein, but the structure may have any number of stages insofar as there are two or more stages. Some of the stages may also be split vector quantization or scalar quantization. The present invention may also be applied when a split structure is adopted instead of a multistage structure.

The quantization performance is further enhanced when a configuration is adopted in which the multistage vector quantization codebook is provided with a different codebook for each set of the prediction coefficient table, and different multistage vector quantization codebooks are used in combination for different prediction coefficient tables.

In the embodiments described above, prediction coefficient tables that correspond to the class information outputted by classifier 207 may be prepared in advance as prediction coefficient tables 210, 310; and the prediction coefficient tables may be switched and outputted. In other words, prediction coefficient tables 210, 310 may be switched and outputted so that selecting switch 251 selects a single sub-codebook (CBa1 through CBan) from first-stage codebook 250 according to the class information that is inputted from classifier 207.

Furthermore, in the embodiments described above, a configuration may be adopted in which switching is performed only for the prediction coefficient tables of prediction coefficient tables 210, 310 rather than for first-stage codebook 250, or both first-stage codebook 250 and the prediction coefficient tables of prediction coefficient tables 210, 310 may be simultaneously switched.

A case was described herein using an example in which the present invention was composed of hardware, but the present invention can also be implemented by software.

An example was also described herein in which a wideband quantized LSP parameter converted from a narrowband quantized LSP parameter was used to perform classification, but classification may also be performed using the narrowband LSP parameter before conversion.

The functional blocks used to describe the abovementioned embodiments are typically implemented as LSI integrated circuits. A chip may be formed for each functional block, or some or all of the functional blocks may be formed in a single chip.

The implementation herein was referred to as LSI, but the implementation may also be referred to as IC, system LSI, super LSI, or ultra LSI according to different degrees of integration.

The circuit integration method is not limited to LSI, and the present invention may be implemented by dedicated circuits or multipurpose processors. After LSI manufacture, it is possible to use an FPGA (Field Programmable Gate Array) that can be programmed, or a reconfigurable processor whereby connections or settings of circuit cells in the LSI can be reconfigured.

Furthermore, when circuit integration techniques that replace LSI appear as a result of progress or development of semiconductor technology, those techniques may, of course, be used to integrate the functional blocks. Biotechnology may also have potential for application.

The present application is based on Japanese Patent Application No. 2004-272481 filed on Sep. 17, 2004, Japanese Patent Application No. 2004-329094 filed on Nov. 12, 2004, and Japanese Patent Application No. 2005-255242 filed on Sep. 2, 2005, the entire contents of which are expressly incorporated by reference herein.

INDUSTRIAL APPLICABILITY

The scalable encoding apparatus, scalable decoding apparatus, scalable encoding method, and scalable decoding method of the present invention can be applied to a communication apparatus or the like in a mobile communication system, a packet communication system that uses Internet Protocol, or the like.

The invention claimed is:

1. A scalable encoding apparatus that performs predictive quantization of a wideband LSP parameter comprising:

a pre-emphasizer that pre-emphasizes a quantized narrowband LSP parameter; and a quantizer that performs the predictive quantization using one of:

the pre-emphasized quantized narrowband LSP parameter that is converted to a first wideband LSP parameter in a wideband form, and a second wideband LSP parameter, which is generated by the pre-emphasizer using a decoded quantized narrowband LSP parameter converted in a wideband form, as the pre-emphasized quantized narrowband LSP parameter.

2. The scalable encoding apparatus according to claim 1, further comprising:

a classifier that performs classification and generation of class information using the first or second wideband LSP parameter; and a multistage vector quantization codebook that has a plurality of codebooks in which at least one codebook among the plurality of codebooks has a plurality of sub-codebooks, and that selectively uses a sub-codebook that corresponds to the class information among the plurality of sub-codebooks to perform multistage vector quantization.

3. The scalable encoding apparatus according to claim 2, wherein: the multistage vector quantization codebook has a plurality of codebooks; a codebook in which an average energy of a stored code vector is at a maximum among the plurality of codebooks has a plurality of sub-codebooks; and a sub-codebook that corresponds to the class information among the plurality of sub-codebooks is selectively used to perform multistage vector quantization.

4. The scalable encoding apparatus according to claim 2, wherein:

the multistage vector quantization codebook has a plurality of codebooks; a codebook used in a first stage of multistage vector quantization among the plurality of codebooks has a plurality of sub-codebooks; and a sub-codebook that corresponds to the class information among the plurality of sub-codebooks is selectively used to perform multistage vector quantization.

5. The scalable encoding apparatus according to claim 2, wherein the multistage vector quantization codebook further comprises a switcher that switches a sub-codebook selected from the plurality of sub-codebooks according to the class information.

6. The scalable encoding apparatus according to claim 2, wherein the classifier stores a plurality of code vectors, and performs classification and generation of class information by specifying the code vector that has the smallest error with respect to the wideband LSP parameter.

7. The scalable encoding apparatus according to claim 2, wherein the classifier stores a plurality of code vectors, quantizes the error between the wideband LSP parameter and each of the plurality of code vectors, and performs classification and generation of class information on the basis of the quantized plurality of errors.

8. A communication terminal apparatus, comprising the scalable encoding apparatus according to claim 1.

9. A base station apparatus comprising the scalable encoding apparatus according to claim 1.

10. A scalable decoding apparatus that decodes a wideband LSP parameter, comprising:

a pre-emphasizer that pre-emphasizes a decoded quantized narrowband LSP parameter; and a LSP parameter decoder that decodes the wideband LSP parameter using one of:

the pre-emphasized quantized narrowband LSP parameter that is converted to a first wideband LSP parameter in a wideband form, and a second wideband LSP parameter, which is generated by the pre-emphasizer using the decoded quantized narrowband LSP parameter converted in a wideband form, as the pre-emphasized quantized narrowband LSP parameter.

11. The scalable decoding apparatus according to claim 10, further comprising:

a classifier that performs classification and generation of class information using the first or second wideband LSP parameter; and a multistage vector quantization codebook that has a plurality of codebooks in which at least one codebook among the plurality of codebooks has a plurality of sub-codebooks, and that selectively uses a sub-codebook that corresponds to the class information among the plurality of sub-codebooks to perform multistage vector quantization.

12. The scalable decoding apparatus according to claim 11, wherein: the multistage vector quantization codebook has a plurality of codebooks; a codebook in which an average energy of a stored code vector is at a maximum among the plurality of codebooks has a plurality of sub-codebooks; and a sub-codebook that corresponds to the class information among the plurality of sub-codebooks is selectively used to perform multistage vector quantization.

13. The scalable decoding apparatus according to claim 11, wherein: the multistage vector quantization codebook has a plurality of codebooks; a codebook used in a first stage of multistage vector quantization among the plurality of codebooks has a plurality of sub-codebooks; and a sub-codebook that corresponds to the class information among the plurality of sub-codebooks is selectively used to perform multistage vector quantization.

14. The scalable decoding apparatus according to claim 11, wherein the multistage vector quantization codebook further comprises a switcher that switches a sub-codebook selected from the plurality of sub-codebooks according to the class information.

15. The scalable decoding apparatus according to claim 11, wherein the classifier stores a plurality of code vectors, and performs classification and generation of class information by specifying a code vector that has a smallest error with respect to the first or second wideband LSP parameter.

16. The scalable decoding apparatus according to claim 11, wherein the classifier stores a plurality of code vectors, quantizes an error between the first or second wideband LSP parameter and each of the plurality of code vectors, and performs classification and generation of class information on the basis of the quantized plurality of errors.

17. A communication terminal apparatus comprising the scalable decoding apparatus according to claim 10.

18. A base station apparatus comprising the scalable decoding apparatus according to claim 10.

19. A scalable encoding method that performs predictive quantization of a wideband LSP parameter, comprising:

pre-emphasizing a quantized narrowband LSP parameter; and performing predictive quantization using one of:

the pre-emphasized quantized narrowband LSP parameter that is converted to a first wideband LSP parameter in a wideband form, and a second wideband LSP parameter, which is generated by the pre-emphasizing using a decoded quantized narrowband LSP parameter converted in a wideband form, as the pre-emphasized quantized narrowband LSP parameter.

20. The scalable encoding method according to claim 19, further comprising:

classifying and generating class information using the first or second wideband LSP parameter; and switching a sub-codebook selected from a plurality of sub-codebooks contained in a codebook according to the class information.

21. A scalable decoding method that decodes a wideband LSP parameter, comprising:

pre-emphasizing a decoded quantized narrowband LSP parameter; and decoding the wideband LSP parameter using one of:

the pre-emphasized quantized narrowband LSP parameter that is converted to a first wideband LSP parameter in a wideband form, and a second wideband LSP parameter, which is generated by the pre-emphasizing using the decoded quantized narrowband LSP parameter converted in a wideband form, as the pre-emphasized quantized narrowband LSP parameter to decode the wideband LSP parameter.

22. The scalable decoding method according to claim 21, further comprising:

classifying and generating class information using the first or second wideband LSP parameter; and switching a sub-codebook selected from a plurality of sub-codebooks contained in a codebook according to the class information.

* * * * *